United States Patent [19]

Minaka et al.

[11] 3,948,022

[45] Apr. 6, 1976

[54] APPARATUS FOR MAKING A CARTONED PACKAGE

[75] Inventors: Eiji Minaka, Kawasaki; Kinyu Ishida, Takatsuki; Norio Ishimaru, Matsuyama, all of Japan

[73] Assignee: Teijin Limited, Osaka, Japan

[22] Filed: Aug. 22, 1974

[21] Appl. No.: 499,852

[52] U.S. Cl. ..... 53/156; 53/176; 53/198 R

[51] Int. Cl.[2] B65B 35/44; B65B 41/18; B65B 13/00

[58] Field of Search ..... 53/156, 198 R, 167, 171, 53/176

[56] References Cited

UNITED STATES PATENTS

| | | | |
|---|---|---|---|
| 2,946,167 | 7/1960 | Clemens | 53/176 X |
| 3,003,296 | 10/1961 | Feldkamp et al. | 53/176 X |
| 3,239,994 | 3/1966 | Etzel et al. | 53/198 R |
| 3,479,792 | 11/1969 | Jensen et al. | 53/198 R X |

*Primary Examiner*—Willie G. Abercrombie
*Assistant Examiner*—Leon Gilden
*Attorney, Agent, or Firm*—Kenyon & Kenyon

[57] ABSTRACT

A plurality of yarn packages are stably held by a pair of protector plates in parallel and non contacting condition to each other so as to form a unit package. The yarn packages are covered with a sheet of film as a whole or separately at a position inside the protector plates. At least one unit package may be packaged in a cardboard box. In a preferable process for making the unit package, a series of successive operations, such as a first protector plate supply, a first film supply, mounting of a predetermined number of yarn packages on the first protector plate by way of the first film, a second film supply on the combined body of the yarn packages with the first protector plate, sealing of the first and second films for wrapping the yarn packages, a second protector plate supply, binding of the first and second protector plates by tapes, packaging at least one unit package in a cardboard box, are successively and intermittently carried out when items are displaced along an assembling conveyer line. In the preferable embodiment of the invention, the protector plates are automatically made from cardboard sheets and holding caps, and then supplied to the respective reserving device adjacent to the assembling conveyer line. plates are automatically made from cardboard sheets and holding caps, and then supplied to the respective reserving device adjacent to the assembling conveyer line.

14 Claims, 66 Drawing Figures

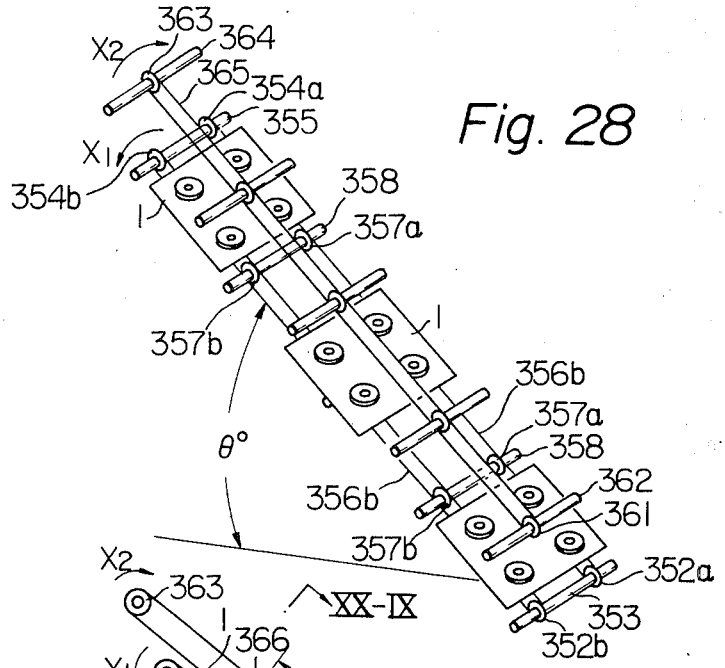
Fig. 28
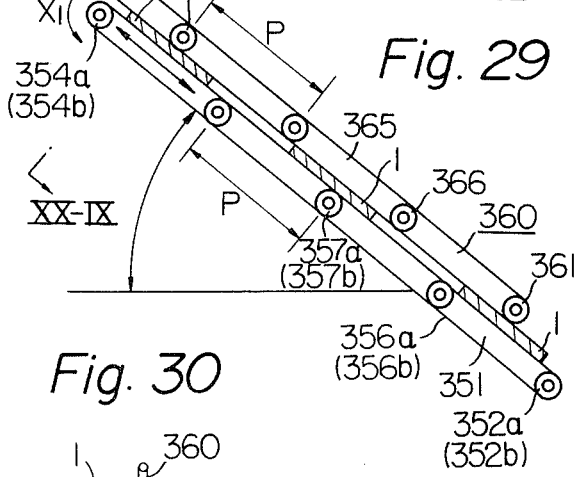
Fig. 29
Fig. 30
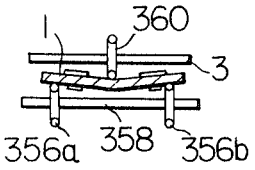

Fig. 31
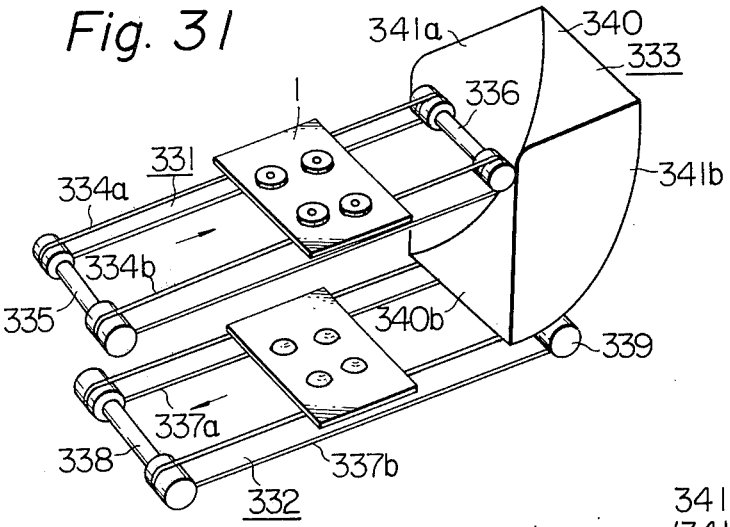
Fig. 32
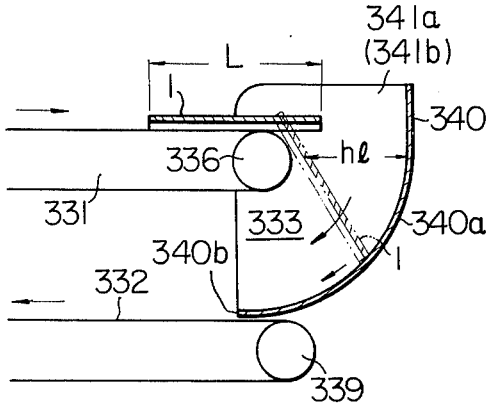
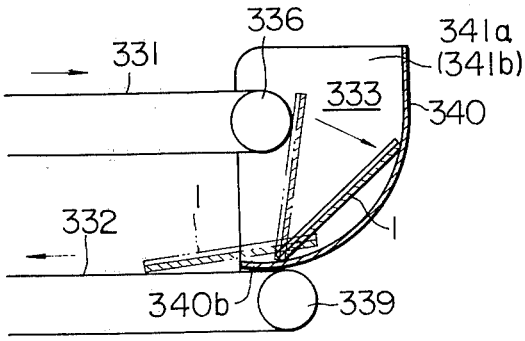
Fig. 33

Fig. 34
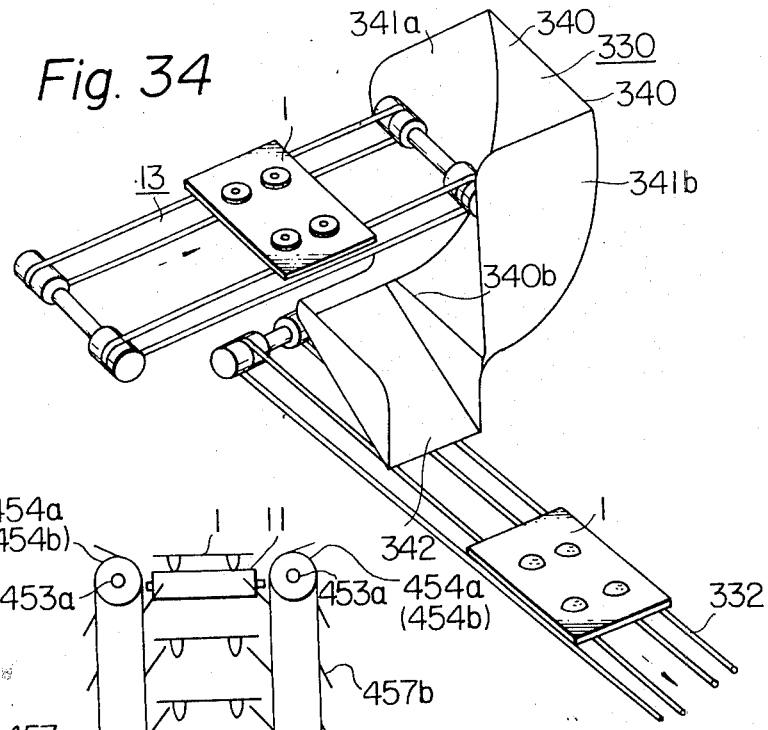
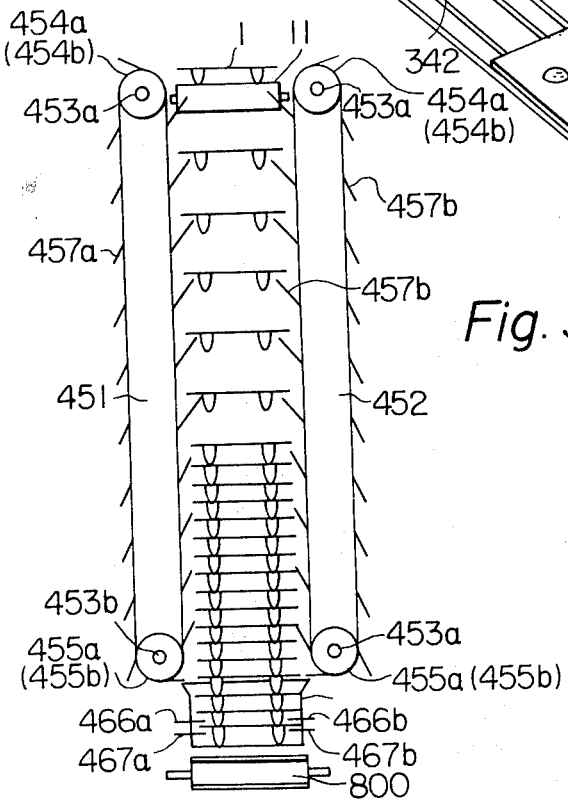
Fig. 35

APPARATUS FOR MAKING A CARTONED PACKAGE

SUMMARY OF THE INVENTION

The present invention relates to a cartoned package of yarn packages, and a method and a series of automatic apparatus for packaging a plurality of yarn packages in a carton.

Generally, in spinning mills producing spun yarns and factories for producing synthetic filament yarns, the manufactured yarns are wound on bobbins so as to form full yarn packages and these full yarn packages are packaged in cartons for shipping. To prevent any possible damage of the yarn packages due to friction or loosening of the yarn during transportation, it is preferable to wrap each yarn package with a paper or synthetic film and then a group of these yarn packages are packaged in a carton. Especially in the case of packaging full yarn packages formed from high quality spun yarn or synthetic multifilament yarns, the above-mentioned wrapping of the full yarn packages with paper or synthetic film is very useful. However, even though the above-mentioned wrapping operation can be carried out by an automatic apparatus, the packaging operation is complicated so that the production cost rather increases.

To solve the above-mentioned problem, a method has been proposed, wherein, rather than wrapping each full yarn package with a paper or film, a plurality of yarn packages are held in a parallel condition by a pair of protector plates in such a way that both ends of the bobbin of each yarn package are held by the protector plates which are bound with tapes or ropes so as to form a unit body, and the unit body is packaged in a carton.

In the above mentioned packaging method, it is necessary to arrange the yarn packages in such a condition that the outer surfaces thereof do not contact each other. A thick paper such as a cardboard is preferably used for the protector plates. However, according to our experience, the protector plates or the carton are often broken by unexpected strong vibration or shock during transportation, so that the surfaces of the yarn packages are often damaged or soiled.

The principla object of the present invention is to provide a novel cartoned package containing a plurality of full yarn packages which is free from the above-mentioned drawback of the previous cartoned package.

A further object of the present invention is to provide an automatic method and a series of automatic apparatus for making the above-mentioned novel cartoned packages.

The cartoned package containing full yarn packages according to the present invention is characterized by a unit package comprising a pair of identical supporting plates or protector plates, each provided with a plurality of holding members symmetrically arranged with respect to the center of the protector plate thereon, a plurality of full yarn packages held by the protector plates in such a condition that both ends of the bobbin of each yarn package are engaged onto corresponding holding members on each protector plate so that the yarn packages are free from contact with each other, a synthetic film covers the yarn packaged bobbins in such a condition that the film intervenes between the bobbins and the protector plates. The abovementioned unit package is bound with a plurality of tapes.

The cartoned package according to the present invention contains at least one above-mentioned unit package therein. In the unit package contained in the cartoned package, a plurality of full yarn packages are held in parallel condition with intervening space therebetween. Consequently, any possible damage or soiling of the full yarn packages during transportation can be perfectly prevented.

In the process for making the above-mentioned cartoned package of full yarn packages, it is, of course, important to reduce the manual labor cost and, therefore, the following method and series of automatic apparatus are created by the present invention. That is, the method for making the cartoned packages of full yarn packages comprises a combination of the following steps and apparatus.

(1) To prepare the above-mentioned protector plates, sheets of cardboard are intermittently fed on a conveyer belt one by one, and a plurality of holding caps, which are members for holding the ends of bobbins, are secured to each sheet of cardboard at predetermined symmetrical positions with respect to the center of the cardboard. The thusly prepared protector plates are fed into a pair of reserve devices for reserving a plurality of protector plates therein. For the sake of better understanding, these reserve devices are hereinafter referred to as first and second reserve devices. As each yarn package is held by two protector plates in such a way that each end of the bobbin of the yarn package is engaged with a holding cap on one of the two protector plates, the relative dispositions of these holding caps on the protector plates must be opposite each other. Therefore, if the protector plates, which are to be reserved in the first and second reserve devices, are prepared at a single assembling station where each carton paper is provided with the holding caps, the protector plates to be reserved in either the first or thee second reserve device must be turned over before being supplied into the reserve device. On the other hand, the protector plates which are fed into the first or second reserve devices may be prepared separately in such a condition that such turning over is not necessary. For the sake of better understanding, the protector plates which are fed into the first reserve device are hereinafter referred to as first protector plates, while the protector plates which are fed into the second reserve device are hereinafter referred to as second protector plates. In addition, the above-mentioned preparation of protector plates is hereinafter referred to as a process for preparing protector plates.

(2) The first protector plates are intermittently transported on a first assembling conveyer belt from a first reserve device, one by one. This process is hereinafter referred to as a process for supplying a first protector plate.

(3) A sheet of thermoplastic synthetic film, having a size which is large enough to wrap a plurality of yarn packages, is disposed on each first protector plate by a first device for supplying the sheet of film after the first protector plate is carried to the working station of said device by the first assembling conveyer belt. This process is hereinafter referred to as a first film supplying process.

(4) Next, the first protector plate with the sheet of film disposed thereon is carried by a second assembling conveyer belt to a station for assembling a predetermined number of full yarn packages on the first protector plate with the film therebetween in such a condition that one end of each yarn packaged bobbin is engaged on a separate catcher ring of the first protector plate with the sheet of the first film therebetween. This process is hereinafter referred to as a process for assembling the yarn packaged bobbins with the first protector plate.

(5) A sheet of thermoplastic film having a size which is large enough to wrap the yarn packaged bobbins is superposed on these bobbins when these yarn packages assembled with the first protector plate are carried by a third assembling conveyer to a working station of a second device for supplying the sheet of film. The second film supply device is provided with a heat seal device for joining the first film with the second film by heat so as to enclose the full yarn packages with the first and second films. This process is hereinafter referred to as a second film supplying and sealing process.

(6) When the yarn packaged bobbins assembled with the first protector plate and wrapped with the first and second films are carried to a working position of the second reserve device by a fourth assembling conveyer, a second protector plate is supplied from the second reserve device and disposed on the yarn packaged bobbins in such a condition that the free end of each bobbin is engaged with a separate holding cap of the second protector plate. This process is hereinafter referred to as a process for supplying the second protector plate.

(7) Next, the assembly of the full yarn packages with the first and second protector plates is carried to a working positions of a pair of conventional binding devices so as to bind the first and second protector plates by a pair of tapes. This process is hereinafter referred to as a binding process. According to the above-mentioned series of seven processes, the above-mentioned unit package is formed.

(8) Thereafter, the unit packages are put into cartons according to the predetermined design of the cartoned package, for example, two unit packages are put into a carton, and the carton is packaged by a conventional packaging machine.

The above-mentioned combined processes are operated intermittently so as to satisfy a predetermined time schedule of the assembling conveyers. It is also practical to use only a single assembling conveyer extending along the entire passage of the above mentioned separated conveyers. In this case, it is required to design the time schedule for carrying out the above mentioned separate processes very carefully so as to not reduce the working efficiency thereof. And in either the case of utilizing a plurality of assembling conveyers or a single conveyer, the operations are controlled so as to satisfy the predetermined time schedule.

As mentioned above, the combined processes for making the unit package of full yarn packages and packaging the unit package or unit packages in a carton are carried out automatically and, consequently, the manual labor cost can be reduced remarkably.

Generally, in a factory for manufacturing synthetic filaments, each yarn package is usually inspected to find yarn defects, undesirable shapes of yarn packages, etc. Therefore, in the fourth step above, the full yarn packages which are assembled with the first protector plate should be perfect yarn packages supplied from the above-mentioned inspection. In this regard, to match with the time schedule for the assembling operation, a plurality of full yarn packages supplied from the inspection operation are reserved at the working station of the fourth process. In our research, an automatic carrying device from the above-mentioned inspection has been created, and it was empirically confirmed that this carrying device can be effectively combined with the fourth process of the present invention. In this case, an automatic device for disposing the yarn packages on a first protector plate may be installed between the carrying device and the second assembling conveyor belt so as to carry out the operation automatically.

As already explained, in the above-mentioned combined processes, each operation is carried out automatically. Therefore, the respective automatic devices are essential for carrying out the packaging operation according to the present invention.

BRIEF EXPLANATION OF THE DRAWINGS

FIG. 28 is a perspective view of an inclined conveyer according to the present invention;

FIGS. 29 and 30 are a side and a front view, respectively, of the inclined conveyer shown in FIG. 28;

FIG. 31 is a perspective view of a device for turning over the protector plate according to the present invention;

FIGS. 32 and 33 are side views, partly in section, of the turning over device shown in FIG. 31;

FIG. 34 is a perspective view of the turning over device in combination with a device for changing the carrying direction of the protector plate according to the present invention;

FIG. 35 is a schematic side view of a device for reserving a first protector plate according to the present invention;

DETAILED DESCRIPTION OF THE PRESENT INVENTION

Cartoned Package of Full Yarn Packages

Figure 1:
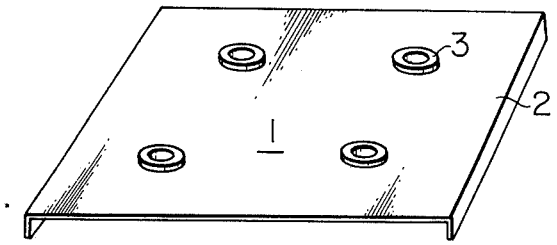
FIG. 1 is a perspective view of a protector plate utilized for making a unit package holding yarn packages according to the present invention.
Figure 2:
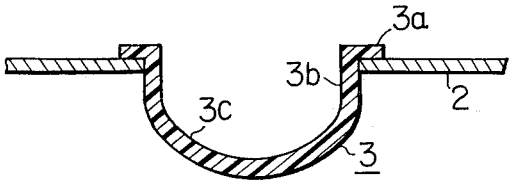
FIG. 2 is a cross sectional view of a holding cap mounted on the protector plate shown in FIG. 1.
Figure 3:
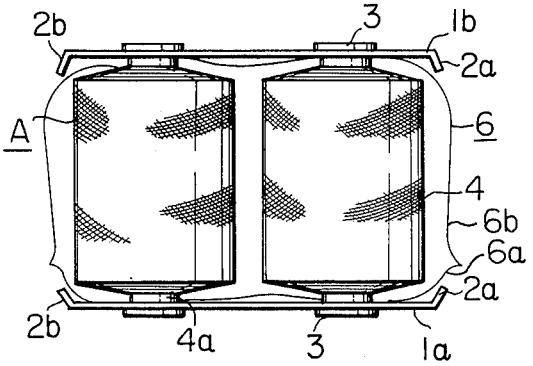
FIG. 3 is a schematic elevational view of a unit package holding yarn packages according to the present invention.

The cartoned package of the full yarn packages according to the present invention is characterized in that these full yarn packages are enclosed with a film and held parallel in such a condition that they are free from possible contact with each other during transportation so that even though the carton is damaged, any possible damage or soiling of the yarn packages can be perfectly prevented. To attain the above-mentioned desirable condition, a very unique construction of the cartoned package has been created. Referring to FIGS. 1, 2 and 3, a pair of protector plates 1 are prepared, each being provided with a plurality of holding caps 3 which are capable of engaging with ends of yarn packaged bobbins 4*a*. In the embodiment shown in FIGS. 1, 2, 3 and 5, the cardboard sheet 2 of each protector plate 1 is provided with four apertures formed at desirable positions thereof, which satisfies the condition for holding the yarn packaged bobbins 4*a* in such a condition that yarn packages 4 are free from any possible contact with each other. That is, the center of these apertures are arranged at four corners of a geometrical square and the distance between two adjacent corners is larger than two times the radius of a yarn package 4. Four holding caps 3 are inserted into the respective apertures of the cardboard sheet 2 so as to form a protector plate 1. Each holding cap 3 is composed of a ring shaped flange portion 3*a* and a cylindrical portion 3*b* projected from the flange portion 3*a* and a cap shaped closed portion 3*c* connected to the cylindrical portion 3*b*. The outside diameter of the cylindrical portion 3*b* is slightly smaller than the inside diameter of the bobbin. Each holding cap 3 is inserted into the above-mentioned aperture of the cardboard sheet 2 in such a way that the cylindrical portion 3*b* thereof is pushed into the abovementioned aperture, as shown in FIG. 2.

Figure 5:
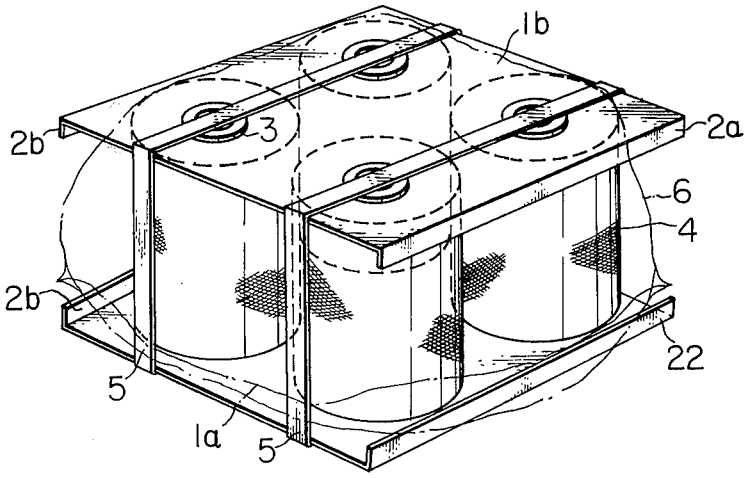
FIG. 5 is a perspective view of the unit package shown in FIG. 3.
Figure 6:
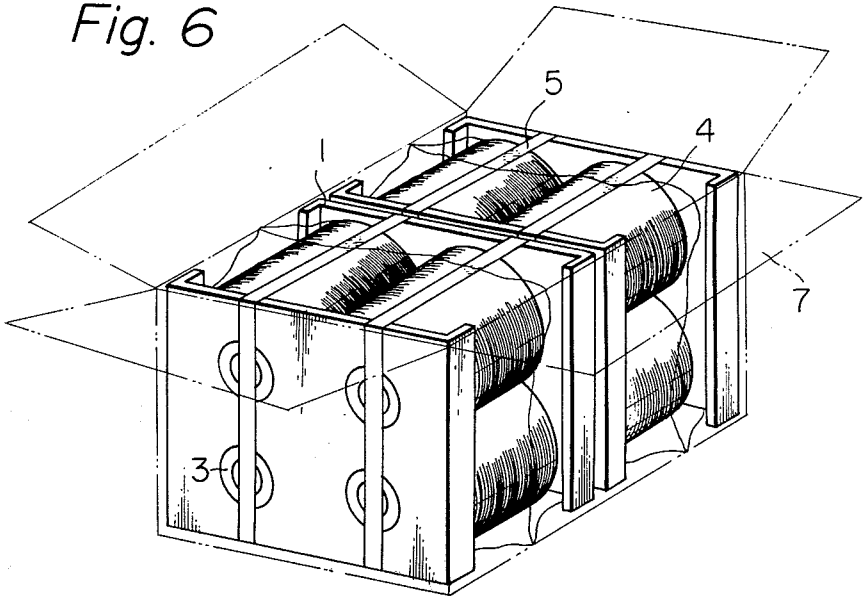
FIG. 6 is a perspective view of a cartoned package containing two unit packages holding the yarn packages according to the present invention.

In a unit package A, a pair of protector plates 1*a*, 1*b* are arranged in such a condition that the two ends of each yarn packaged bobbin 4*a* are engaged with the holding caps 3 of these protector plates 1*a*, 1*b*, and these protector plates 1*a*, 1*b* are firmly bound with a pair of tapes 5. To prevent any possible damage or soiling of the yarn packages when the outside of the carton or the cardboard sheet 2 is broken during transportation, the full yarn packages 4 held by the protector plates 1*a*, 1*b* are covered with a sheet of film 6 in such a condition that the film 6 intervenes between the bobbins 4*a* and the protector plates 1*a*, 1*b*. To ensure stable positioning and easy handling of the unit package A in the carton, the cardboard sheet 2 of each protector plate 1 is provided with a pair of folded edges 2*a*, 2*b* formed so that they face each other when a unit package A is assembled, as shown in FIG. 5. Double (or single) unit packages A are packaged in a carton 7 by a conventional packaging machine, as shown in FIG. 6.

Figure 4:
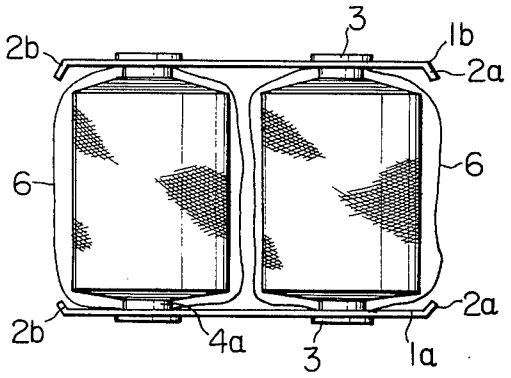
FIG. 4 is a schematic elevational view of a modified unit package holding yarn packages according to the present invention.

In a modified unit package A according to the present invention, instead of wrapping a plurality of yarn packages 4 by a sheet of film 6 as a whole as shown in FIG. 3, each yarn package 4 may be wrapped with a sheet of film separately as shown in FIG. 4.

As mentioned above, if the carton 7 contains a plurality of full yarn packages 4 according to the present invention, any possible damage or soiling of the yarn packages 4 during transportation can be perfectly prevented. Moreover, in both the packing and later unpacking of the carton, the above-mentioned unit package A can be easily handled so that working efficiency can be remarkably increased.

If the total lot size of the packaging is not too large, the unit packages A may be produced and packaged manually. However, for large lot sizes, it is essential that the production and packaging operations be carried out automatically in order to reduce the time and manual labor costs which would otherwise be involved. As hereinafter described in detail, the method and series of automatic apparatus for packaging a plurality of full yarn packages 4 in a carton 7 according to the present invention satisfies the above-mentioned automatic packaging requirement.

Method for Packaging a Plurality of Full Yarn Packages

Before explaining the series of automatic apparatus for making the cartoned package according to the present invention in detail, the successive steps for making the above-mentioned cartoned package is illustrated.

Figure 7:
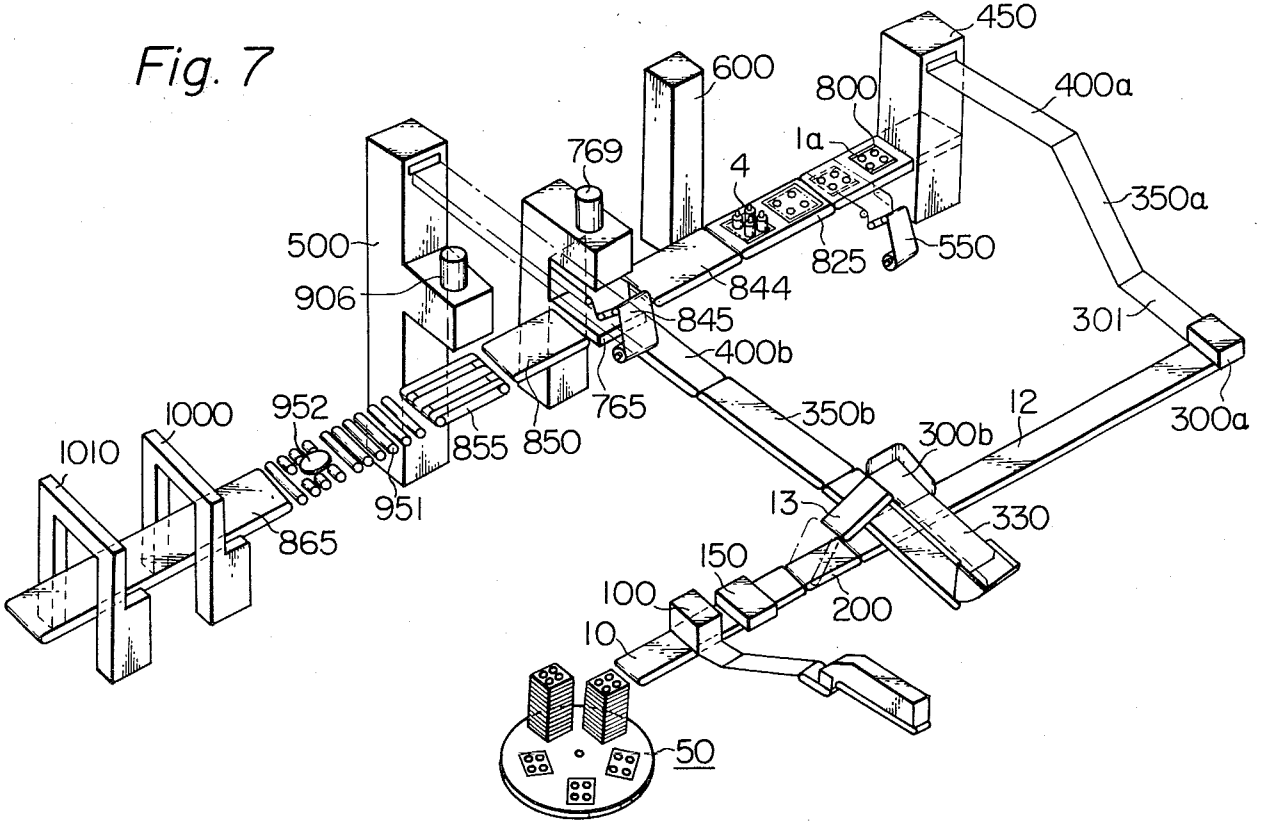
FIG. 7 is a schematic side view of a system for making cartoned packages like the cartoned package shown in FIG. 6, according to the present invention.
Figure 8:
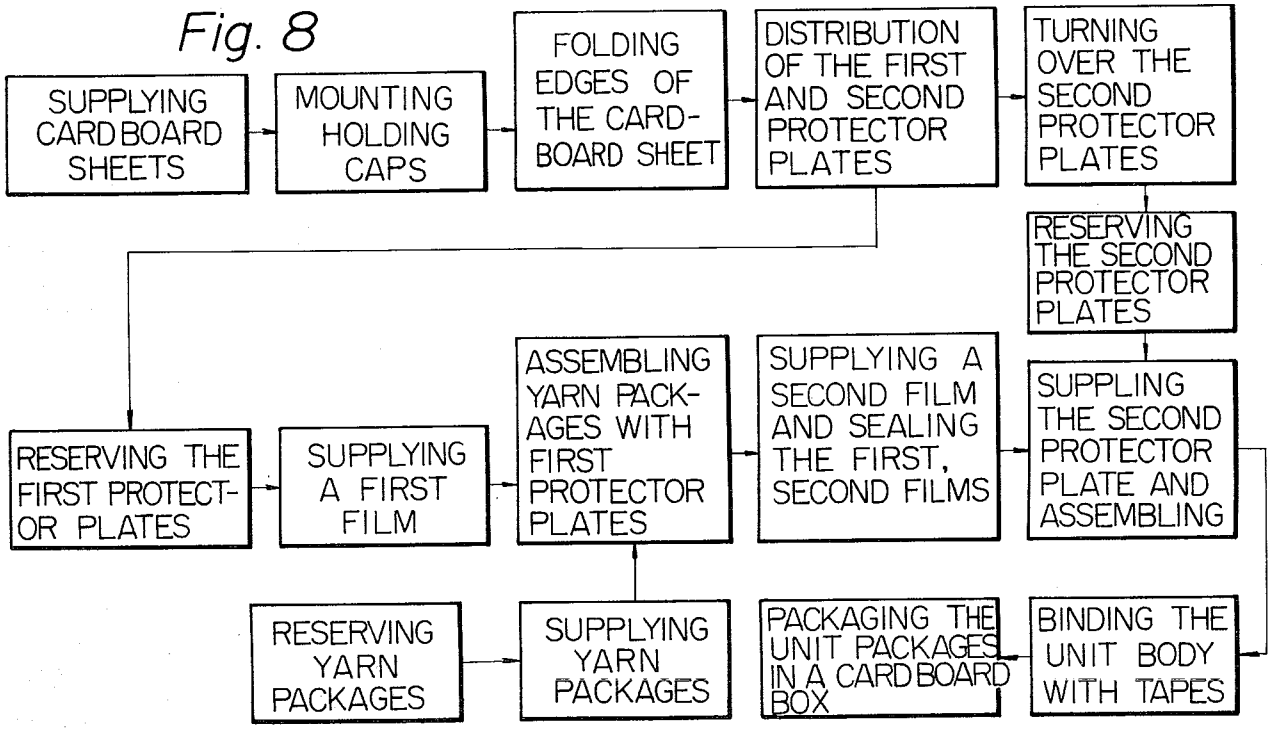
FIG. 8 is a block diagram of the cartoned package making system shown in FIG. 7.

Referring to FIGS. 7 and 8, in the process for preparing the protector plates 1, cardboard sheets 2 are intermittently, singly fed onto a first conveyer belt 10 from a cardboard sheet supply device 50. The above-mentioned cardboard sheets 2 are each previously provided with four apertures for accepting holding caps 3 as already explained. A device 100 for mounting the holding caps 3 on each cardboard sheet 2 is disposed at a position adjacent above the first conveyer belt 10. When a cardbord sheet 2 is carried to the working position of the mounting device 100, four holding caps 3 are inserted into the respective apertures of the cardboard sheet 2 so that a protector plate 1 is produced. To provide the pair of folded edges 2*a*, 2*b*, a device 150 for folding the edges of each protector plate 1 is disposed along the passage of the first conveyer belt 10. After the protector plate 1 is carried over the folding device 150, the successive protector plates 1 are fed onto a second conveyer belt 12 or a third conveyer belt 13 alternatively by means of a distribution conveyer 200. The protector plates 1 fed onto the second conveyer belt 12 are supplied into a first reserve device 450 by way of a first intermediate transporting means while the protector plates 1 fed onto the third conveyer belt 13 are supplied into a second reserve device 500 by way of a second intermediate transporting means. The first intermediate transporting device comprises a device 300*a* for changing the carrying direction of the protector plates 1 carried by the second conveyer belt 12 and a first inclined conveyer belt 350*a* which carries the protector plates 1 from the device 300*a* to a fourth conveyer belt 400*a* which supplies the protector plates 1 into the first reserve device 450. On the other hand, the second intermediate transporting device comprises a device 330 for turning over the protector plates 1 and a second inclined conveyer belt 350*b* which carries the protector plate 1 from the turning over device 330 to a fifth conveyer belt 400*b* connected to the second reserve device 500. As mentioned above, the cardboard sheets 2 fed on the first conveyer belt 10 are provided with the holding caps 3 by the catcher ring mounting device 100, and after forming the folded edges 2*a*, 2*b* on each protector plate 1, a group of protector plates 1 are fed on the second conveyer belt 12 connected to the first reserve device 450, while another group of protector plates 1 are fed on the third conveyer belt 13 connected to the second reserve device 500, and during the transportation of the protector plate 1 to the second reserve device 500, the protector plates 1 are turned over by the turning over device 330.

The first protector plate reserve device 450 is disposed at a position adjacent to an upstream end of a first assembling conveyer belt 800 in such a way that the first assembling conveyer belt 800 is capable of taking a single first protector plate 1*a* from the reserve device 450 at each one stroke forward motion thereof. In the abovementioned supply motion of the first protector plate 1*a*, the holding caps 3 of the protector plate 1*a* are maintained their apertures opening upward so as to be able to receive the lower ends of the yarn packaged bobbins 4*a*. When a first protector plate 1*a* is carried to the working station of the first film supply device 550, a sheet of first synthetic film 6*a* having a predetermined size is superposed on the first protector plate 1*a*.

Next, the combined body of the first protector plate 1*a* with the film 6*a* is carried by a second assembling conveyer belt 825 to a station where a plurality of full yarn packages 4 are assembled with the first protector plate 1*a* combined with the first film 6*a*.

According to our experience, there is a certain possibility of adhering a free end portion of the first-film on the conveyor belt 800 when the above-mentioned combined body is transferred from the conveyer belt 800 to the second assembling conveyer belt 825. To prevent the above-mentioned trouble of adhering the first film on the conveyer belt 800, air flow directed to upward through an intervened space between the conveyer belt 800 and the second conveyer belt 825 is formed by means of a suitable pneumatic nozzle means disposed at a position below the abovementioned intervened space.

At this assembling station, an automatic device 600 for assembling the full yarn packages 4 with the first protector plate 1*a* is installed. In this embodiment, a plurality of full yarn packages 4 supplied from an inspection process are reserved at their waiting position adjacent to the device 600. The device 600 picks up four yarn packages 4 from their waiting position and carries them above the assembling station and then positions these yarn packages 4 on the first protector plate 1*a*, which is stopped at the assembling station, in such a way that the bottom end of each yarn packaged bobbin 4*a* is inserted into the apertures of the respective holding cap 3 of the protector plate 1*a*. It is also possible to combine the packaging system of the present invention with a system for inspecting defects of the full yarn packages 4 by the abovementioned automatic assembling device 600 in such a way that the above-mentioned waiting position is used as a position for reserving full yarn packages 4 which are selected as normal yarn packages for shipping by the inspection system. However, if the total lot size of yarn packages to be produced is small, instead of utilizing the above-mentioned automatic assembling device 600, the assembling operation may be carried out manually.

After completion of the above-mentioned assembling operation of yarn packages 4 with the first protector plate 1*a* combined with the first film 6*a*, the assembled body is carried by means of an intermediate conveyer belt 844 to a second film supply station on a third assembling conveyer belt 845 and stopped at this station. At this station, a second thermoplastic synthetic film 6*b* having a size which is large enough to wrap the yarn packages 4 together with the film 6*a*, is supplied to the assembled body in such a way that the film 6*b* is capable of contacting the film 6*a*. Then the films 6*a*, 6*b* are sealed by a device for sealing films. In the present invention, the above-mentioned device for supplying the film 6*b* and device for sealing the films 6*a*, 6*b* are combined in an apparatus 700 which is hereinafter referred to as a film supply and sealing device.

In the transportation of the combined body, composed of the first protector plate and a first film together with the yarn packages, from the second conveyer belt 825 to the intermediate conveyer belt 844, and from the intermediate conveyer belt 844 to the third conveyer belt 845, the above-mentioned pneumatic nozzle means is utilized to prevent the adherence of the first film on the conveyer belts 825, 844 respectively.

Next, the assembled body, wherein the yarn packages are enclosed by the films 6*a*, 6*b*, is carried to a station by a fourth assembling conveyer belt 255 for assembling the above-mentioned assembled body with a second protector plate 1*b*. At this station, a second protector plate 1*b* supplied from the second reserve device 500 is supplied on top of the assembled body in such a way that each holding cap 3 of the plate 1*b* engages the upper end of the respective bobbin 4*a* held by the corresponding holding cap 3 of the first protector plate 1*a*. Because in the assembled body the yarn packages 4 are wrapped with the films 6*a*, 6*b* as mentioned above, the film 6*b* intervenes between the protector plate 1*b* and the yarn packages 4. In this embodiment, the protector plates 1*a* and 1*b* are reserved in the respective devices 450, 500 in such a condition that when they are supplied the folded edges 2*a* and 2*b* are positioned so as to coincide with the two sides of the first assembling belt conveyer 800 and the fourth assembling conveyer belt 855, respectively, and; the assembled body comprising four yarn packages 4 and a pair of protector plates 1*a*, 1*b*, which hold the bobbins 4*a*, is bound by a pair of tapes 5 at edge positions without folded edges 2*a*, 2*b* as shown in FIG. 5. Therefore, the above-mentioned assembled body is turned 90° at a turning and transporting conveyer 865 by a turning device 900 before being carried to the station for binding, by a fifth assembling conveyer belt 895. At this binding station, the above-mentioned assembled body is bound with a pair of tapes 5 by a pair of conventional binding devices, 1000, 1010.

If a very rigid cardboard sheet is utilized as a material for the protector plate 1, it may omit the folded portions 2*a*, 2*b* from the protector plate. In this case, the above-mentioned turning operation may be excluded from the process for making the unit packages of the full yarn packages according to the present invention.

According to the above-mentioned assembling operation, unit packages A are successively produced. Thereafter, a conventional operation for packaging a cartoned package which contains a single unit package A or a plurality of unit packages A, is carried out. For better understanding the above-mentioned automatic method for packaging the cartoned package of a plurality of full yarn packages 4, a block diagram indicating the successive individual operations is shown in FIG. 8.

As mentioned above, because the series of assembling operations for producing the unit packages A are carried out systematically on the respective assembling conveyer belts by means of the automatic devices, under controlled time sequences, the labor costs can be remarkably reduced from the conventional method, in spite of the complicated construction of the unit package A. Further, it is important to realize that the cartoned package of a plurality of full yarn packages 4 has perfect function which protects the yarn packages 4 from possible damage or soiling during the transportation.

Automatic Devices Utilized for the Present Invention

A preferred embodiment of an automatic device for supplying cardboard sheets on the first conveyer belt 10 is hereinafter explained in detail. Referring to FIGS. 9, 10, 11 and 12, the above-mentioned supplying device is provided with a turn table 51 which is driven by a motor 53 mounted on a machine frame 52.

The turn table 51 is provided with a plurality of wheels 56 turnably mounted to a circular bottom edge portion thereof so as to be able to rotate on a ring shaped guide rail 57 secured to the machine frame 52. Consequently, the turn table 51 is capable of turning on the guide rail 57 in stable condition. The turn table 51 is further provided with a plurality of round apertures 54 formed at symmetrical positions with respect to the rotational center thereof. In this embodiment, four apertures 54 are formed. At a position below the turn table 51, which position is adjacent to the first conveyer belt 10, a motor driven cylinder 63 is disposed in such a condition that a plunger 64 of the cylinder 63 is capable of passing a point on a trace circle of a center of the apertures 54. A horizontal table 62 is secured to a top end of the plunger 64. The diameter of the table 62 is smaller than the diameter of the aperture 54 and, therefore, when the turn table 51 is held at a position in such a condition that the center of an aperture 54 coincides with the axial center of the plunger 64, the table 62 is capable of passing through the aperture 54 according to the motion of the plunger 64. The above-mentioned position of the turn table 51 is hereinafter referred to as a working position thereof. The turn table 51 is provided with a vertical shaft 55 which is rotated by the motor 53 by way of a power transmission device 58 comprising a conventional reduction gear train and a friction clutch which is actuated by a solenoid (not shown). Four projections 59 are secured to a bottom surface of the table 51 at positions corresponding to the above-mentioned four apertures 54. At a position between the cylinder 63 and the vertical shaft 55 there is provided a solenoid 60 which works to stop the turn table 51 at the working position thereof. That is, a plunger 61 of the solenoid 60 is capable of engaging with the projection 59 when the solenoid 60 is actuated.

Figure 11:
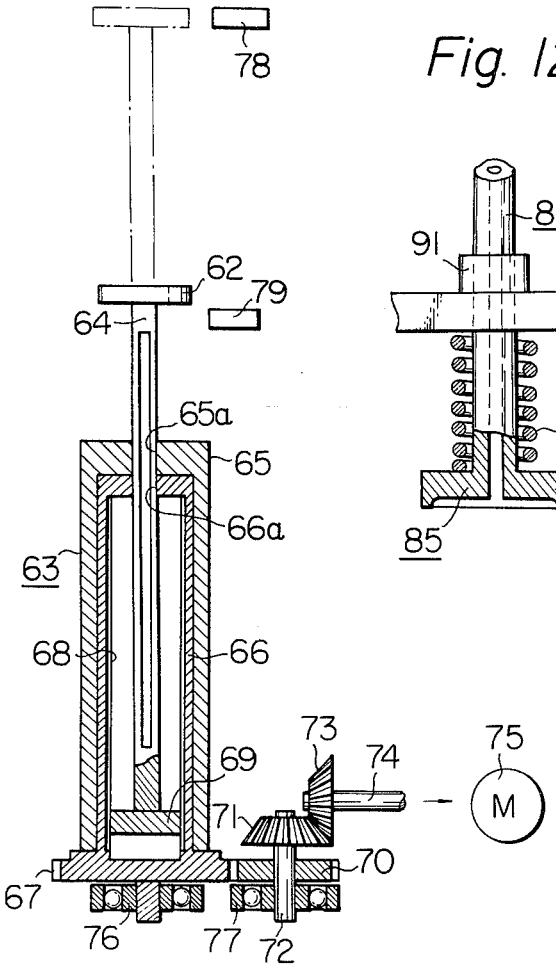
FIG. 11 is a cross sectional view of a motor driven cylinder utilized for the cardboard supply device according to the present invention.

The motor driven cylinder 63 comprises a cylindrical guide member 65 rigidly held by the machine frame, a cylindrical gear member 66 provided with a gear 67 formed at its bottom end and a cylindrical inside wall 68 wherein a piston 69 is thread engaged. A mechanism for actuating the motor driven cylinder 63 comprises a gear 70 engaged with the gear 67, a bevel gear 71 secured to a shaft 72 of the gear 70, a bevel gear 73 meshed with the bevel gear 71 and secured to a shaft 74 driven by a reversible motor 75. The gears 67 and 70 are turnably held by respective bearings 76 and 77, and the plunger 64 is rigidly connected to the piston 69 and spline engaged with an aperture 65*a* of the cylindrical guide member 65. The plunger 64 is slidably engaged with an aperture 66*a* formed at the top end of the cylindrical gear member 66. As mentioned above, the piston 69 is provided with a threaded cylindrical outer surface which engages with an inside threaded cylindrical wall 68 of the cylindrical gear member 66 as shown in FIG. 11. Consequently, when the gear member 66 is driven, the piston 69 is capable of displacing upward or downward according to the turning direction of the gear member 66.

At two positions adjacent to a path of the table 62, a pair of limit switches 78, 79, which are non contact limit switches, are disposed at the upper and lower terminal of the stroke of the table 62. And when the limit switch 78 detects the arrival of the table 62 at the upper terminal of the stroke thereof, the switch 78 issues a signal to drive the motor 75 in a direction for displacing the piston 69 downward. When the limit switch 79 detects the arrival of the table 62 at the lower terminal thereof, the motor 75 is stopped for a predetermined time and thereafter the motor 75 is driven in a direction for displacing the piston 69 upwards. This latter driving direction of the motor 75 is hereinafter referred to as normal running of the motor 75.

Figure 12:
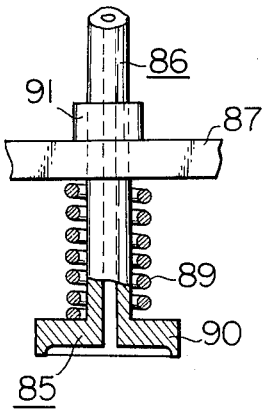
FIG. 12 is a side view of the vacuum catcher utilized for the cardboard supply device shown in FIG. 10.
Figure 13:
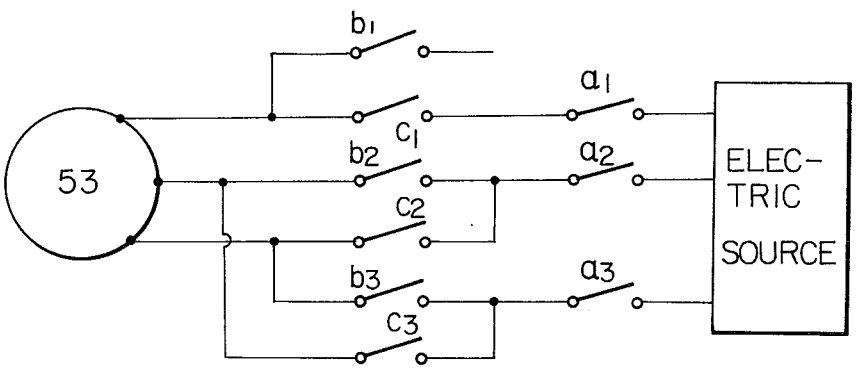
FIG. 13 is a magnetic relay for controlling the motion of the motor driven cylinder shown in FIG. 11.
Figure 14:
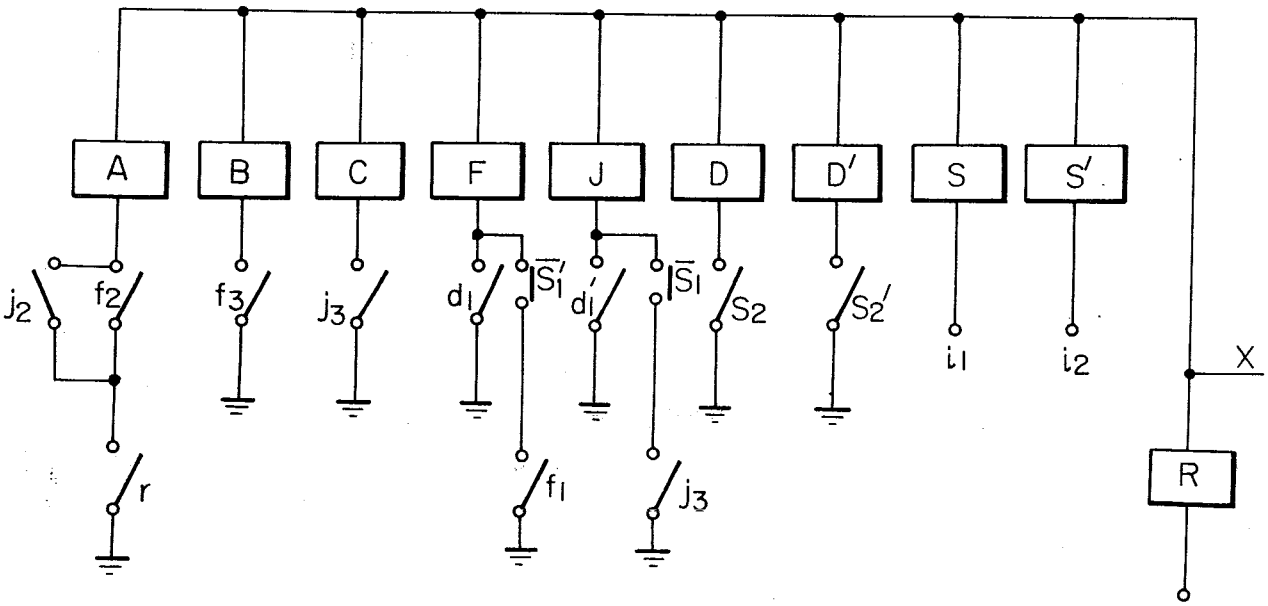
FIG. 14 is an electric control circuit for controlling the motion of the motor driven cylinder shown in FIG. 11.

A light projector 80 and a photocell 81 are disposed at a position for further controlling the motion of the plunger 64 so as to stop normal running of the motor 75 by detecting existence of a cardboard sheet 2. A plurality of superposed cardboard sheets 2, for example, four superposed cardboard sheets 2, are mounted on the turn table 51 at the respective positions of the apertures 54. For the sake of better understanding, these block of the superposed cardboard sheets 2 are identified by $X_1$, $X_2$, $X_3$ and $X_4$ in FIG. 3. When, for example, the aperture 54 facing the block $X_1$ of the cardboard sheets 2 is positioned at its working position, the block $X_1$ of the cardboard sheets is capable of displacing upward toward the working position of the light projector 80 and the photocell 81 by the motion of the plunger 64. The normal running of the motor 75 is controlled by a control signal issued by the photocell 81, detecting the existence of a cardboard sheet 2, in such a way that the upper surface of the block $X_1$, $X_2$, $X_3$ and $X_4$ of the superposed cardboard sheets 2 is always positioned at the working position of the light projector 80 and the photocell 81. Instead of the above-mentioned light projector 80 and the photocell 81, a limit switch means for detecting the cardboard sheet 2 can be utilized. The above-mentioned operation is controlled by means of the control circuits shown in FIGS. 13 and 14. Referring to FIGS. 13 and 14, the motor 53 is connected to an electric source by means of contacts $a_1$, $a_2$, $a_3$ and $b_1$, $b_2$, $b_3$, $c_1$, $c_2$ and $c_3$. In the control circuit, there are provided eight relays A, B, C, F, J, S, S′ and R, and two delayed relays D and D′ for actuating the control circuit in such a way that the contacts $a_1$, $a_2$ and $a_3$ are controlled by the relay A, the contacts $b_1$, $b_2$ and $b_3$ are controlled by the relay B, and the contacts $c_1$, $c_2$ and $c_3$ are controlled by the relay C. It is apparent from FIGS. 12 and 13 that the motor 53 rotates in the normal direction when both the relays A and C are energized, and it rotates in the reverse direction when the two relays A and B are energized. The relay F has contacts $f_1$, $f_2$ and $f_3$, the relay J has contacts $j_1$, $j_2$ and $j_3$, the relay S has normal close contact $s_1$ and normal open contact $s_2$, the relay S′ has normal close contact $s'_1$ and normal open contact $s_2$, and the relay R has a contact $r$. One terminal of each relay is connected to the electric source.

The relay R is energized and the contacts $r$ closes when the signal from the photocell 81 is applied to the relay R. The limit switch 79 issues a signal to energize the relays A and C. When the relays A and C are energized and the motor 53 is rotating in the normal direction at the initial condition, the contacts $r$, $j_1$, $j_2$, $j_3$, $s_1$ and $s_2$ are closed, thus the relays A, C and J are energized. When the signal $i_1$ is applied to the relay S, the relay S is energized, then the contact $s_1$ opens while the contact $s_2$ closes. Since the contact $s_1$ opens, the relay J is deenergized and the contacts $j_1$, $j_2$ and $j_3$ open, then the relays A and C are deenergized, thus the motor 53 stops running. Further, since the contact $s_2$ is closed, the delay relay D starts the operation. The delay relay D receives a pulse type input signal from the contact $s_2$ and after a predetermined period, for instance 10 seconds, it provides a pulse type output signal by closing the contact $d_1$. Ten seconds later, the delay relay D is energized and the contact $d_1$ closes, then the relay F is energized and the contacts $f_1$, $f_2$ and $f_3$ are closed. Accordingly, the relay F is selfheld, since the normal close contact $s_1$ is closed at this time. Since the contacts $f_2$ and $f_3$ are closed, the relays A and B are energized, causing the contacts $a_1$, $a_2$, $a_3$, $b_1$, $b_2$ and $b_3$ to be closed. Consequently, the motor 53 rotates again but in the reverse direction. Next, the signal $i_2$ applied to the relay S causes the similar operation to that explained above, that is, stopping the motor 53 and ten seconds later, starting again the motor 53 in the normal direction. This later driving direction of the motor 75 is hereinafter referred to normal running of the motor 75.

Figure 9:
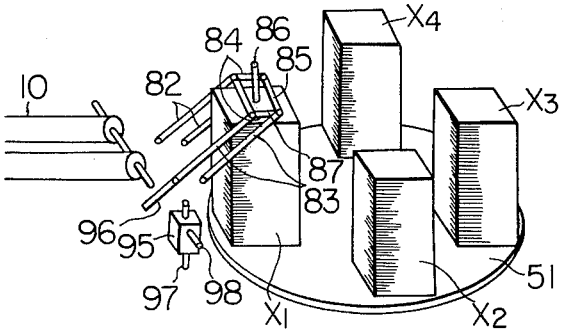
FIG. 9 is a schematic perspective view of a device for supplying cardboard sheets on a first conveyer belt according to the present invention.
Figure 10:
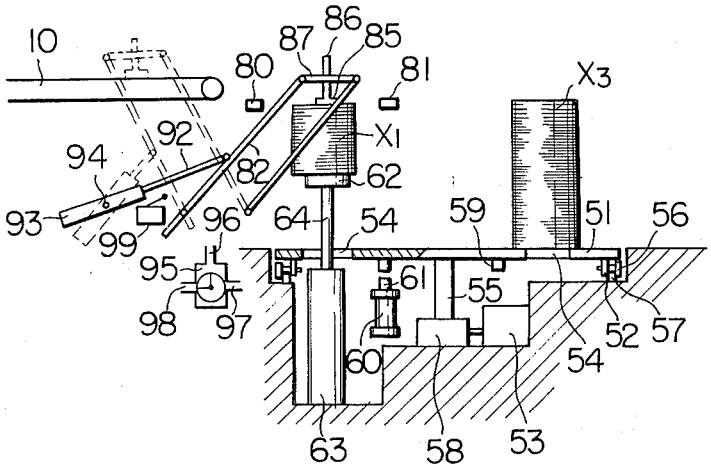
FIG. 10 is a schematic side view, partly in section of the cardboard supply device shown in FIG. 9.

A light projector 80 and a photocell 81 are disposed at a position for further controlling the motion of the plunger 64 so as to stop normal running of the motor 75 by detecting existence of a cardboard sheet 2. A plurality of superposed cardboard sheets 2, for example, four superposed cardboard sheets 2, are mounted on the turn table 51 at the respective positions of the apertures 54. For the sake of better understanding, these block of the superposed cardboard sheets 2 are identified by $X_1$, $X_2$, $X_3$ and $X_4$ in FIG. 8. When, for example, the aperture 54 facing the block $X_1$ of the cardboard sheets 2 is positioned at its working position, the block $X_1$ of the cardboard sheets is capable of displacing upward toward the working position of the light projector 80 and the photocell 81 by the motion of the plunger 64. The normal running of the motor 75 is controlled by a control signal issued by the photocell 81, detecting the existence of a cardboard sheet 2, in such a way that the upper surface of the block $X_1$, $X_2$, $X_3$ and $X_4$ of the superposed cardboard sheets 2 is always positioned at the working position of the light projector 80 and the photocell 81. Instead of the above-mentioned light projector 80 and the photocell 81, a limit switch means for detecting the cardboard sheet 2 can be utilized. When the light beam created by the light projector 80 is blocked by the upper portion of the block $X_1$, $X_2$, $X_3$ and $X_4$ of the superposed cardboard sheets 2, the signal issued from the photocell 81 is eliminated so that the relay R opens the connection between the electric source and the motor 75. Therefore, even though the remained relays close the connection between the electric source and the motor 75. Therefore, even though the remained relays close the connection between the electric source and the motor 75, the driving of the motor 75 is stopped. Means for transferring a cardboard sheet 2 from the top of the block of the superposed cardboard sheets 2 on the aperture 54 in the working position to the first conveyor belt 10 is provided with a pair of parallel crank mechanisms 82, 83, a pair of bars 84 which connect the parallel crank mechanisms 82 and 83, a vacuum catcher 85 which is connected to a connecting conduit 86. The vacuum catcher 85 is supported by a holding member 87 secured to the bars 84 as shown in FIGS. 9 and 12. That is, the vacuum catcher 85 is slidably held by the holding member 87 in such a way that a stem portion thereof 88 slidably passes through a guide aperture of the holding member 87 and a helical expansion spring 89 is mounted on the stem portion 88 at a position between the holding member 87 and a laterally expanded bottom head 90 of the vacuum catcher 85. To prevent escape of the stem portion 88 from the holding member 87, a stopper 91 is secured to the stem portion 88. Consequently, the vacuum catcher 85 is capable of displacing upward or downward in resilient condition. The parallel crank mechanisms 82, 83 are connected to a piston rod 92 of a pneumatic cylinder 93 which is turnably supported by a pin 94. Consequently, the parallel crank mechanisms 82, 83 are capable of moving from a position represented by a solid line to a position represented by a boken line in FIG. 10. The position of the parallel crank mechanisms 82, 83 represented by the above-mentioned broken line coincides with a position for transferring a cardboard sheet 2 from the vacuum catcher 85 to the first conveyer belt 10. The connecting conduit 86 is connected to a first outlet 96 of a three-way magnetic valve 95 which is connected to a vacuum source (not shown) by way of an inlet 97 thereof. The valve 95 is further provided with a second outlet 98 which is always connected with the atmosphere, and the connection between the inlet 97 and the first outlet 96 is changed to a connection between the second outlet 98 and the first outlet 96 by actuation of a magnetic mechanism (not shown) mounted on the valve 95. To actuate the valve 95, a limit switch 99 is disposed at a position where the crank mechanism 82 is capable of actuating the limit switch 99 when the parallel crank mechanism 82 is turned to the above-mentioned transfer position. Consequently, when the limit switch 99 is actuated by the crank mechanism 82, the limit switch 99 issues a signal for actuating the magnetic mechanism of the three-way magnetic valve 95 so that the connection between the first outlet 96 and the inlet 97 is changed to a connection between the second outlet 98 and the first outlet 96. According to the above-mentioned action of the three way magnetic valve 95, the vacuum chatcher 85 looses the force for holding a cardboard sheet 2.

The speed for supplying cardboard sheets 2 from the turn table 51 to the conveyer belt 10 is decided by the actuation cycle of the pneumatic cylinder 93. The superposed cardboard sheets 2 are disposed on the respective apertures 54 before the operation, or they are disposed on the table 51 at the respective apertures 54 beside the aperture 54 positioned at the working position thereof during the operation. For example, if the pneumatic cylinder 93 is actuated at 10 cycles/minute, and the thickness of a cardboard sheet 2 is 5 mm, and the turn table 51 is quarter turned every quarter of an hour, the initial height of each block of the superposed cardboard sheets 2 disposed on the table 51 at the respective apertures 54 is $(5 \text{ mm} \times 10 \times 60)/4 = 750$ mm.

After positioning the cardboard sheets 2 on the turn table 51, the motor 75 is actuated so as to displace the table 62 upward until the photocell 81 detects the arrival of a cardboard sheet 2. As already illustrated, the photocell 81 is capable of actuating a relay R (FIG. 14) interposed between an electric source and the motor 75 and the relay R is closed during the time the photocell 81 receives a light projected from the light projector 80.

Next the cylinder 93 is actuated so as to turn the crank mechanisms 82, 83 to the position identified by the solid line and the bottom head 90 of the vacuum catcher 85 contacts the upper surface of the cardboard sheet 2. At this time, the three-way magnetic valve 95 connects the first outlet 96 with the inlet valve 97 and, consequently, the uppermost cardboard sheet 2 is held by the bottom head 90 of the vacuum catcher 85. Thereafter, the pneumatic cylinder 93 is actuated so as to turn the crank mechanisms 82, 83 to the position identified by the broken line. When the crank mechanisms 82, 83 are turned to the position identified by the broken line, the three-way magnetic valve 95 changes the connection between the first outlet 96 and the inlet 97 to the connection between the first outlet 96 and the second outlet 98 and, therefore, the catching and the second outlet 98 and, therefore, the catching force of the vacuum catcher 85 is eliminated so that the cardboard sheet 2 is released from the bottom head 90 of the vacuum catcher 85. Thus the cardboard sheet 2 is transferred from the turn table 51 to the first conveyer belt 10.

According to the above-mentioned supply motion of the cardboard sheet 2 from the block of the superposed cardboard sheets 2 mounted on the aperture 54 positioned at the working position, the height of the block of the superposed cardboard sheets 2 is decreased so that the photocell 81 receives a light projected from the light projector 80. Therefore, the photocell 81 issues a signal to actuate the motor 75 so that the table 62 is displaced upward until the uppermost cardboard sheet 2 blocks the passage of the light projected from the light projector 80 and the light is not received by the photocell 81. Thereafter, when the uppermost cardboard sheet 2 is picked up from the block of the superposed cardboard sheets 2 by the vacuum catcher 85, the table 62 is again displaced upward so as to position the uppermost cardboard sheet 2 at the working position of the vacuum catcher 85. As the vacuum catcher 85 is resiliently held by the holding member 87 by means of the spring 89, a very precise motion of the motor-driven cylinder 63 is not required. When the cardboard sheets 2 of, for example, block $X_1$ are exhausted, that is, when the limit switch 78 detects the arrival of the table 62, the limit switch 78 issues an electric signal so as to drive the motor 75 toward a direction for displacing the piston 69 downward. When the limit switch 79 detects the arrival of the table 62, the switch 79 issues an electric signal so as to stop the running of the motor 75, the solenoid of the power transmission device 58 is actuated so as to turn the table 51 and the solenoid 60 is simultaneously actuated so as to stop the turning motion of the table 51 at the working position of the next aperture 54. During the above-mentioned turning motion of the turn table 51, the supply motion of the cardboard sheet 2 from the turn table 51 to the first conveyor belt 10 is stopped. However, when the next block, for example $X_2$, of the cardboard sheets 2 is positioned at the above-mentioned working position over the next aperture 54, and the light projected from the light projector 80 toward the photocell 81 is shut out by the uppermost cardboard sheet 2 of the block $X_2$, the pneumatic cylinder 93 is again actuated so as to turn the crank mechanisms 82, 83 to the position represented by the solid line and, consequently, the supplying operation is again commenced.

As mentioned above, the supply motion of the cardboard sheets 2 to the first conveyor belt 10 is carried out automatically except for the initial placement of the cardboard sheets 2 on the turn table 51 and, as a result, labour costs can be reduced.

Device for Mounting Holding Caps 3 on the Cardboard Sheet 2

Referring to FIGS. 7, 15, 16, 17, 18 and 19, the cardboard sheets 2 transferred from the supply device 50 to the conveyer belt 10 are displaced to the working station of the device for mounting holding caps 3 on the cardboard sheet 2 successively. The above-mentioned device is hereinafter referred to as a catcher ring mounting device and identified by reference numeral 100 in FIG. 7. The conveyer belt 10 comprises a pair of endless belts 10*a*, 10*b* disposed in parallel condition, and a stopper 102 is disposed at a position adjacent to the working position of the cathcer ring mounting device 100. The stopper 102 is connected to a plunger of a pneumatic cylinder 101 so that the stopper 102 is capable of displacing upward in such a way that the stopper 102 is projected above the upper surface of the endless belts 10*a*, 10*b* when the pneumatic cylinder 101 is actuated. That is, when a cardboard sheet 2 is displaced to the working position of the holding up mounting device 100 by the endless belts 10*a*, 10*b*, a detector (not shown) such as a limit switch or photoelectrical detector (not shown) detects the arrival of the cardboard sheet 2 and the pneumatic cylinder 101 is actuated by a signal issued from the above-mentioned detector. Consequently, the displacement of the cardboard sheet 2 by the endless belts 10*a*, 10*b* is stopped by contact with the stopper 102.

Figure 15:
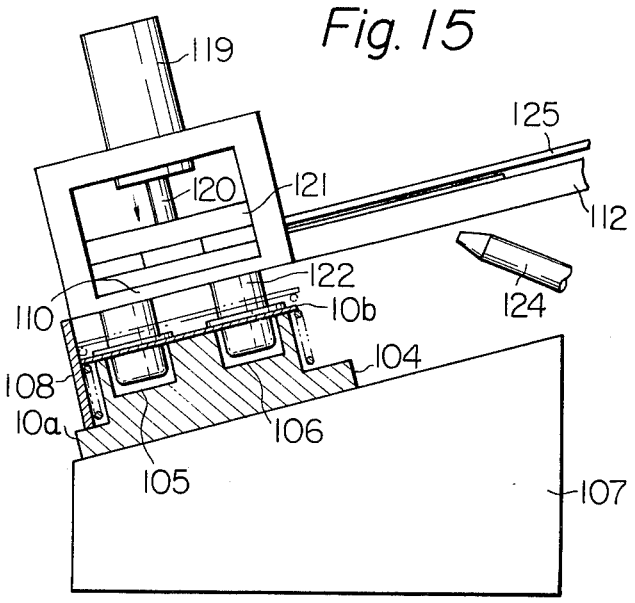
FIG. 15 is a schematic side view of a device for mounting holding caps on the cardboard sheet according to the present invention.
Figure 16:
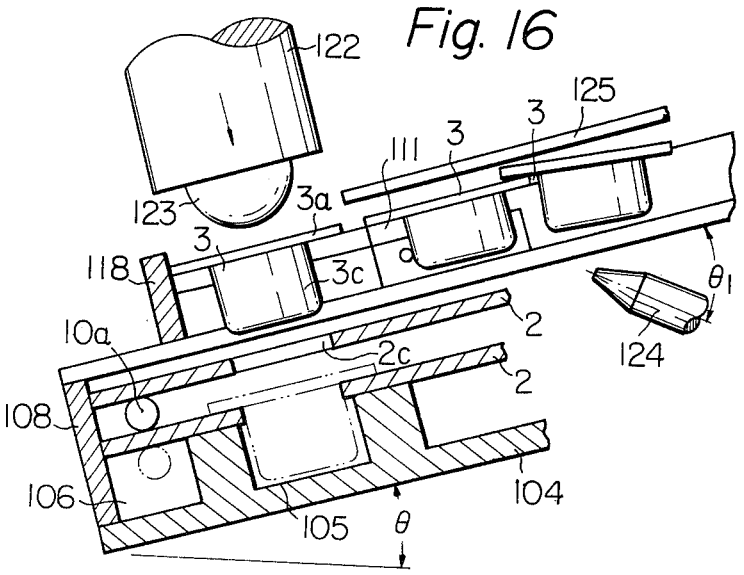
FIG. 16 is a side view of a part of the holding cap mounting device shown in FIG. 16.
Figure 17:
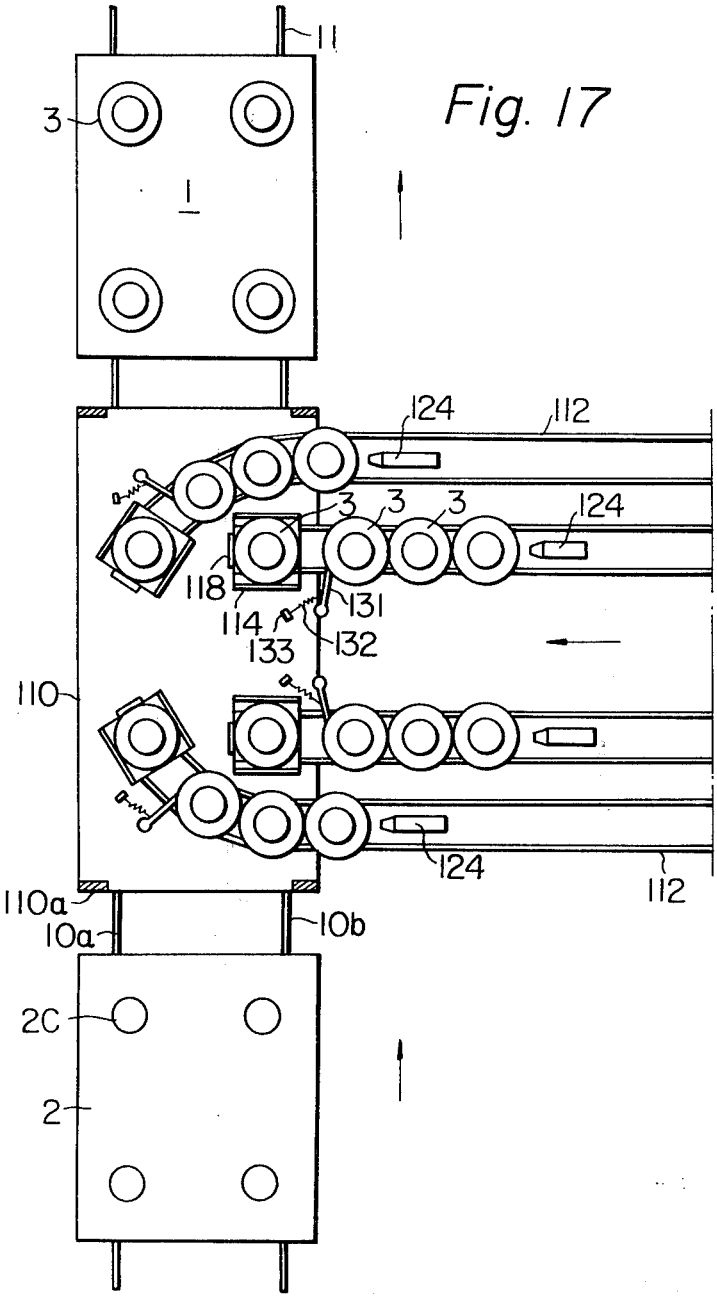
FIG. 17 is a schematic plan view of a part of the holding cap mounting device shown in FIG. 16.
Figure 18:
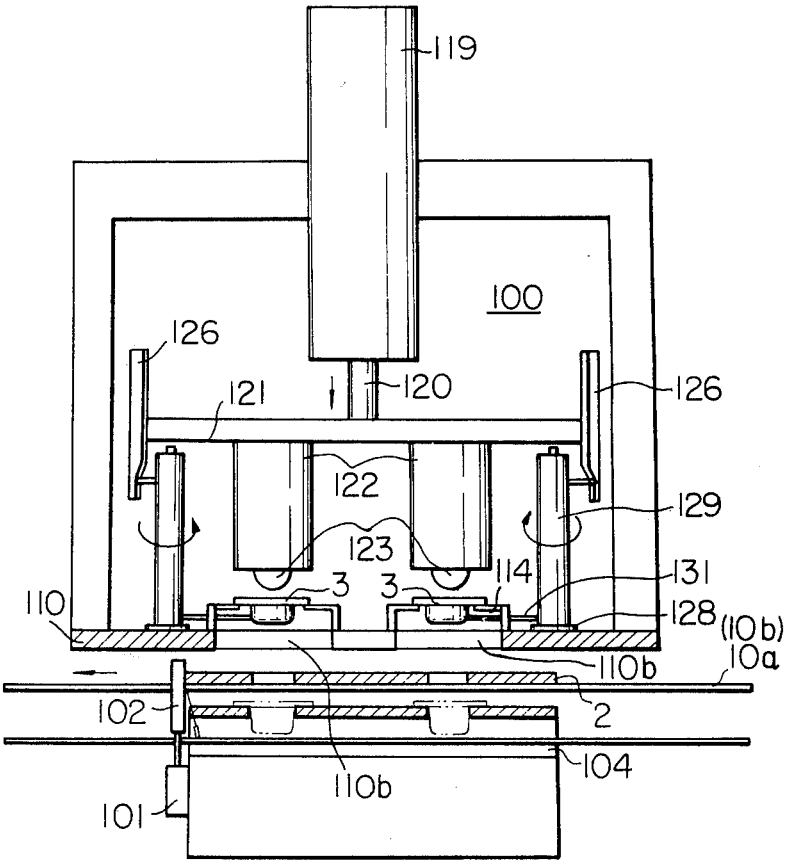
FIG. 18 is a detailed side view of the holding cap mounting device shown in FIG. 16.
Figure 19:
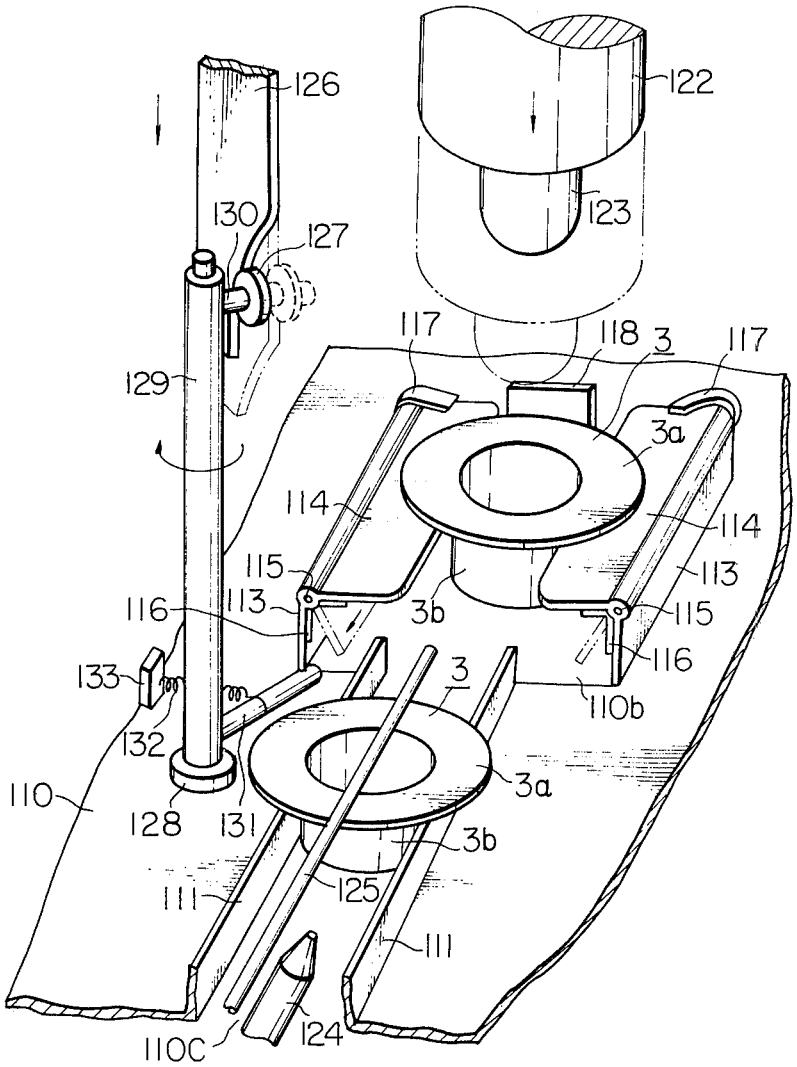
FIG. 19 is a perspective view of a part of the holding cap mounting device shown in FIG. 16.

At the above-mentioned working station of the device 100, an anvil 104 is disposed at a position on a base frame 107 of the device 100, which is slightly below the carrying surface of the endless belts 10*a*, 10*b* as shown in FIG. 15. The anvil 104 is provided with a pair of grooves 105 and 106 which are capable of receiving the projected portion 3*c* of each catcher ring 3 when the holding caps 3 are pushed into the respective apertures 2*c* of the cardboard sheet 2 as shown in FIG. 16. Therefore, even if the endless belts 10*a* and 10*b* are deformed downward by a force for pushing the projected portion 3*c* into the respective apertures 2*c* of the cardboard sheet 2, the anvil 104 is capable of stably supporting the cardboard sheet 2 together with the holding caps 3. In the embodiment shown in FIGS. 15 through 19, the upper carrying surfaces of the endless belts 10*a*, 10*b*, and the upper surface of the anvil 104 incline transversely as shown in FIG. 15. The above-mentioned inclined angle ($\theta$) of the conveyer belt 10 and the anvil 104 is chosen in a range between 5° and 45°. A guide plate 108 is disposed along the conveyer belt 10*a* in such a way that the upper edge thereof is projected upward beyond the upper surface of the endless belt 10*a* and, therefore, the cardboard sheets 2 are always carried along the guide plate 108 so that possible transversal displacement of the cardboard sheet 2 during transportation can be perfectly prevented. The device 100 is further provided with a supporting plate 110 disposed above the endless belts 10*a*, 10*b* in such a way that the plate 110 is parallel to the transferring surface of the conveyer belt 10. In this embodiment, a rectangular supporting plate 110 is rigidly hedl by frames 110*a* as shown in FIG. 17. The supporting plate 110 is provided with a plurality of square shaped apertures 110*b*, for example, four apertures 110*b* in this embodiment, formed at positions right above the apertures 2*c* of the cardboard sheet 2 when the sheet 2 is positioned by the stopper 102 (FIGS. 18 and 19). The supporting plate 110 is further provided with a plurality of guide grooves 110*c*, each connected to the respective square aperture 110*b* (FIG. 19). The size of each square aperture 110*b* is sufficiently large to permit free passage of the holding cap 3 therethrough, while the width of each guide groove 110*c* is larger than the outside diameter of the cylindrical portion 3*b* of the holding cap 3 but is smaller than the outside diameter of the flange portion 3*a* of the holding cap 3. A pair of inside guide rails 111 are projected upward from the edges of the guide grooves 110*c* respectively (FIG. 19). A plurality of pairs of outside guide rails 112 are provided on the device 100 in such a condition that each pair of guide rails 112 is connected to the outside terminals of the corresponding inside guide rails 111 and the outside terminals of each pair of guide rails 112 are connected to means (not shown) for reserving the above-mentioned holding cap 3 (FIGS. 15 and 17). Each pair of guide rails 112 slopes downward from the upstream terminal thereof at an angle of $\theta$°. The holding caps 3 reserved in the above-mentioned reserving means are supplied to the respective pairs of guide rails 112 in such a way that the caps 3 are capable of sliding along each pair of guide rails 112 toward the respective pairs of inside guide rails 111, and are finally displaced to the position of the corresponding square aperture 110*b*. A pair of guide plates 113 are projected upward from the edges of the square apertures 110*b* in such a way that the guide plates 113 are arranged in parallel condition to an extended direction of the groove 110*c*, a pin 115 is mounted on the upper edges of each guide plate 113, and swing plate 114 is turnably mounted on each pin 115 as shown in FIG. 19. A spring 116 is also mounted on each pin 115 so as to resiliently turn the swing plate 114 upward. A stopper 117 is rigidly mounted on each guide plate 113 in such a condition that the turning motion of the swing plate 114 is restricted at the horizontal positions thereof. The size of these swing plates 114 is so designed that when the pair of swing plates 114 are held in the horizontal position, the intervened distance between the free edges of these swing plates 114 coincides with the intervened distance between the pair of inside guide rails 111, and the spaces between the swings plates 114 and the ends of the inside guide rails 111 are quite small so that the holding caps 3 is smoothly transferred from the inside guide rails 111 to the swing plates 114. A stopper 118 is rigidly mounted on the supporting plate 110 at a position for stopping the sliding motion of a holding cap 3 on the pair of swing plates 114 so as to position it at the working station of the holding cap mounting device 100 (FIGS. 15, 16 and 19). Therefore, when a holding cap 3 is supplied from the pair of guide rails 111 to the swing plates 114, the holding cap 3 is stopped when it contacts the stopper 118. At the above-mentioned working position of the device 100, means are provided for engaging the holding caps 3 with the corresponding apertures 2*c* of the cardboard sheets 2. This engaging means comprises a pneumatic cylinder 119 held by the frame of the device 100, a holding member 121 connected to a piston rod 120 of the pneumatic cylinder 119 in such a way that the holding member 121 is capable of displacing downward towards the cardboard sheet 2 positioned at the working station on the conveyer belt 10, a plurality of pushing members 122, that is, four pushing members 122 in this embodiment, projected from the holding member 121 downward in such a way that these pushing members 122 are relatively arranged so as to be able to push downward the corresponding holding caps 3 positioned at the working station of the device 100 as shown in FIG. 18. The pneumatic cylinder 119 is actuated so as to displace the piston rod 120 downward by a signal issued from a detector which is actuated by the stopper 102. Consequently, when the cardboard sheet 2 carried by the conveyer 10 contacts the stopper 102 and is stopped at the working position of the device 100, the pneumatic cylinder 119 is actuated so that the pushing members 122 are displaced toward the conveyer belt 10. According to the above-mentioned downward motion of the pushing members 122, holding caps 3 held by the pairs of swing plates 114 are displaced toward the cardboard sheet 2 held by the conveyer belt 10, because the pair of swing plates 114 are turned about the pins 115 according to the downward displacement of the pushing members 122 and, finally, each holding cap 3 escapes from the swing plates 114 and the caps 3 are pushed into the respective apertures 2*c* of the cardboard sheet 2. It is preferable to provide a spherical head 123 at a bottom end of each pushing member 122 so that the head 123 will directly contact the projected portion 3*c* of the holding cap 3 when the pushing members 122 are displaced downward, so that if the cardboard sheet 2 happens to be positioned at a slightly biased position from the working station of the device 100, the pushing members 122 are capable of working correctly. After pushing the holding caps 3 into the respective apertures 2*c* of the cardboard sheet 2, the pneumatic cylinder 119 displaces the pushing members 122 upward, and the swing plates 114 are turned to their horizontal dispositions by the force of the springs 116, while the stopper 102 is retraced from the upper surface of the conveyor belt 10 and, consequently, the cardboard sheet 2 provided with the holding caps 3 is discharged from the working station of the device 100 by the conveyer belt 10.

When the swing plates 114 are returned to their horizontal positions, the next holding caps 3 are supplied from the guide rails 111 to the corresponding swing plates 114 according to the sliding motion of each holding cap 3. However, according to our experience, the holding caps 3 are often stopped on the guide rails 111 because of frictional resistance between the holding caps 3 and the rails 111. To prevent the above-mentioned trouble, in the present invention at least one jet nozzle 124 is disposed below each set of rails 111, 112 at an angle $\theta_1°$, so as to assist the sliding motion of the holding caps 3 thereon by ejecting air toward the holding caps 3 as shown in FIG. 16. It is preferable to dispose a stopper 125 at a superposed adjacent position above the guide rails 111, 112 in such a condition that the stopper 125 permits the sliding motion of the holding caps 3 on the guide rails 111, 112 but prevents possible escape of the holding caps 3 from the guide rails 111, 112.

It is required that only a single holding cap 3 be held on a pair of swing plates 114 and, therefore means for displacing an excess holding cap 3 off of the swing plates 114 and toward the rails 111 is mounted on the supporting plate 110. Referring to FIGS. 18 and 19, a cam plate 126 is secured to the holding member 121 at a corresponding position adjacent to each pushing member 122. An upright shaft 129 is turnably held by the supporting plate 110 by way of a bearing 128. A roller 127 is turnably mounted on a supporting shaft 130 secured to the upright shaft 129 in such a way that the roller 127 is capable of engaging with the cam surface of the cam plate 126. A rod 131 is projected from the upright shaft 129 at the bottom portion thereof, and a bracket 133 is projected upward from the supporting plate 110. The rod 131 is connected with the bracket 133 by way of a tension spring 132 so that the roller 127 is always urged to the cam surface of the cam plate 126. The rod 131 is so designed that it is capable of pushing a holding cap 3 carried to a position extending from the guide rails 111 to the pair of swing plates 114, toward the guide rails 112, when the rod 131 is turned. And the cam surface of the cam plate 126 is so designed that, the rod 131 of the upright shaft 129 is turned toward the guide plates 111 when the holding member 121 is displaced downward. When the mounting of the holding caps 3 on the cardboard sheet 2 is completed and thereafter the holding member 121 is displaced upward, the rod 131 is turned to its waiting position where free passage of a holding cap 3 toward the swing plates 114 is allowed.

Device for Folding a Pair of Edges of a Cardboard Sheet 2

Figure 20:
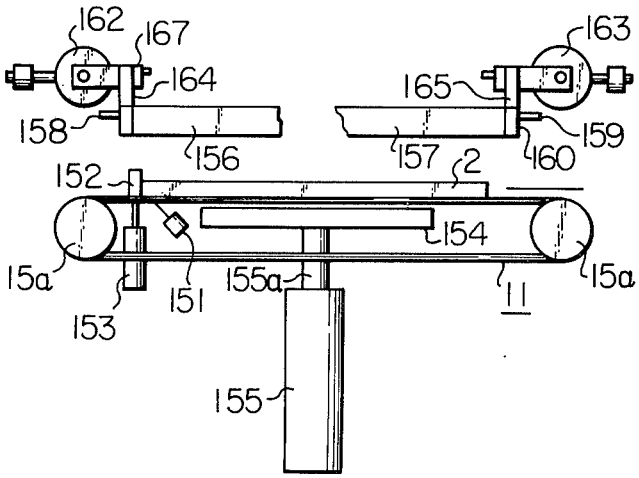
FIG. 20 is a schematic side view of a device for folding edges of a protector plate according to the present invention.
Figure 21:
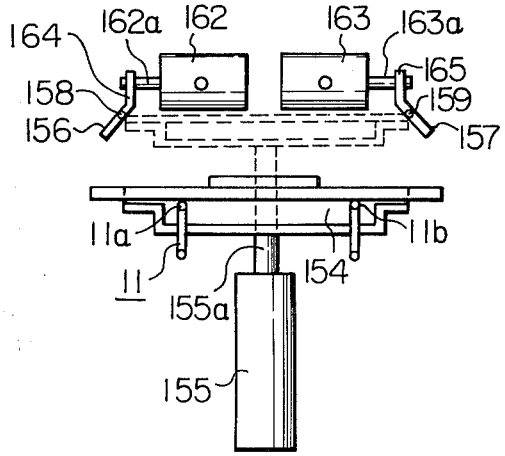
FIG. 21 is a schematic elevational view of the folding device shown in FIG. 20.

Referring to FIGS. 7, 20 and 21, a cardboard sheet 2 provided with a plurality of holding caps 3 is carried to a working station of a device 150 for folding a pair of edges of a cardboard sheet 2 by a second conveyer 11 comprising a pair of endless belts 11*a*, 11*b* mounted on a pair of rollers 15*a*, 15*b*. The folding device 150 is provided with a limit switch 151 disposed at a position below the working station thereof in such a way that a feeler of the limit switch 151 detects the arrival of the cardboard sheet 2 at the above-mentioned working station. A stopper 152 is disposed at a forward terminal of the working station and a pneumatic cylinder 153 is disposed below the stopper 152. The stopper 152 is connected to a plunger of the pneumatic cylinder 153 so that the stopper 152 is capable of projecting upward beyond the carrying surface of the second conveyer 11. Instead of the pneumatic cylinder 153, a solenoid may be utilized with an identical working result. An anvil 154 is disposed at working station of the device 150 in such a condition that the anvil 154 is capable of displacing upward or downward through an intervened space between the endless belts 11*a*, 11*b*, and another pneumatic cylinder 155 is disposed below the anvil 154 so as to displace the anvil 154, that is, the anvil 154 is connected to a top end of the plunger 155*a* of the pneumatic cylinder 155. At a position adjacent to the upper terminal of the motion of the anvil 154, there is provided a folding means comprising a pair of pressing plates 156, 157. These pressing plates 156, 157 are provided with shafts 158, 159, turnably supported by the frame of the device 150, respectively. A pair of pneumatic cylinders 162, 163 are mounted on the device 150. These pneumatic cylinders 162, 163 are provided with plungers 162*a*, 163*a*, respectively, which are connected to the shafts 158, 159 by way of corresponding connecting members 164, 165, respectively. In the above-mentioned device 150, the pneumatic cylinders 153, 155 are actuated by a signal issued from the limit switch 151. Instead of utilizing the limit switch 151, a photoelectric detector may be used.

When the limit switch 151 detects the arrival of a cardboard sheet 2 at the working station of the device 150, the limit switch 151 issues a signal to actuate the pneumatic cylinders 153 and 155. Consequently, the stopper 152 is displaced upward by the pneumatic cylinder 153 beyond the carrying surface of the second conveyer 11 so that the cardboard sheet 2 is stopped at the working station of the device 150. In the above-mentioned stopped condition, both end portions 2*a*, 2*b* of the cardboard sheet 2 extend outside the space where the anvil 154 passes. Simultaneously with the actuation of the pneumatic cylinder 153, the pneumatic cylinder 155 is actuated by the signal issued from the limit switch 151 so that the anvil 154 is displaced upward, and the upward displacement of the anvil 154 is stopped when the anvil 154 urges the cardboard sheet 2 against the pressing plates 156, 157. According to the above-mentioned motion of the anvil 154, the edges 2*a*, 2*b* of the cardboard sheet 2 are folded a little as shown in FIG. 19. When the anvil 154 is displaced to the upper terminal of the displacement thereof, a limit switch (not shown) detects the arrival of the anvil 154 at the above-mentioned upper terminal, and the pneumatic cylinders 162, 163 are actuated by the signal issued from the limit switch (not shown) so as to turn the pressing plates 156, 157 downward. Consequently, the end portions 2*a*, 2*b* are further folded. In the above-mentioned operation, it is preferable to fold the end portion 2*a*, 2*b* of the cardboard sheet 2 less than 90°. Therefore, the stokes of the plungers of the pneumatic cylinders 162, 163 are set so as to fold the end portions 2*a*, 2*b* as mentioned above. After completion of the above-mentioned folding operation, the pneumatic cylinders 162, 163 are operated so as to turn the pressing plates 156, 157 toward their respective waiting positions which are almost their horizontal disposition and, then, the pneumatic cylinder 155 is actuated to displace the anvil 154 downward toward the waiting position thereof, while the pneumatic cylinder 152 is also actuated to retract the stopper 152 from the carrying surface of the conveyer 11. Consequently, the cardboard sheet 2 provided with the folded end portions 2*a*, 2*b* and holding caps 3 is carried to the successive station. Thus, a preparation of a protector sheet 1 is completed.

Distribution Conveyer

As already explained, the protector plates 1 that is the first protector plates 1*a* and the second protector plates 1*b*, are made by the cardboard supply device 50, holding cap mounting device 100 and device 150 for folding a pair of edges 2*a*, 2*b* of the cardboard sheets 2, automatically. However, the unit package A is protected by a first protector plate 1*a* and a second protector plate 1*b* as already explained. These first and second protector plates 1*a* and 1*b* are supplied from the first reserve device 450 and the second reserve device 500, respectively. As the protector plates 1 delivered from the folding device 150 are supplied to the first reserve device 450 and the second reserve device 500, it is necessary to be able to alternatively distribute the protector plates 1 onto two supplying means which are connected to the first and second reserve devices 450, 500. A distribution conveyer 200 is utilized for alternatively supplying the protector plates 1 to the supplying means of the first and second reserve devices 450 and 500.

Figure 22:
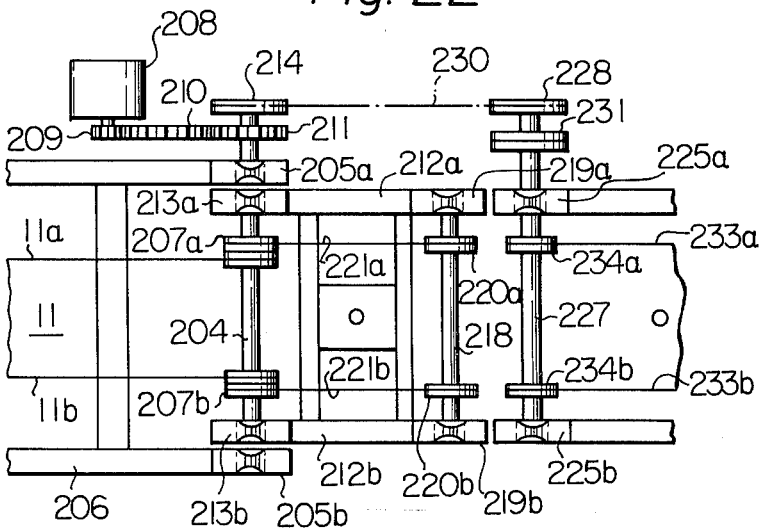
FIG. 22 is a plan view of a distribution conveyer according to the present invention.
Figure 23:
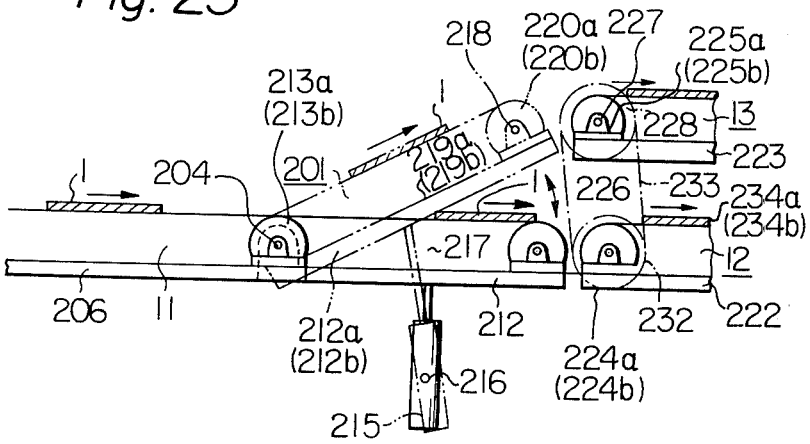
FIG. 23 is a schematic side view of the distribution conveyer shown in FIG. 22.

Referring to FIGS. 22 and 23, the distribution conveyer 200 comprises a swingable conveyer 201, and a pair of conveyers 12, 13 disposed in superposed condition to each other and means for connecting a conveying passage of the swingable conveyer 201 to either one of the conveyers 12 and 13 alternatively. The swingable conveyer 201 always receives the protector plates 1 discharged from the second conveyer 11 and transfers the protector plates 1 to one of the conveyers 12 and 13, which are connected to the first reserve device 450 and the second reserve device 500, respectively. The detailed construction of the distribution conveyer 200 is hereinafter explained in detail with reference to the drawings of FIGS. 22 and 23.

A horizontal shaft 204 is turnably supported by a pair of bearings 205*a*, 205*b* rigidly mounted on a base frame 206 of the second conveyer 11 comprising a pair of endless belts 11*a*, 11*b*. These blets 11*a*, 11*b* are driven by pulleys 207*a*, 207*b* rigidly mounted on the shaft 204. The shaft 204 is driven by a driving mechanism comprising a motor 208, a gear 209 secured on a shaft of the motor 208, an intermediate gear 210 meshed with the gear 209, a gear 211 rigidly mounted on the shaft 204 in such a way that the gear 211 meshes with the intermediate gear 210. A swingable conveyer 201 is provided with a base frame 212 swingably supported by the shaft 204 in such a way that a pair of side frames 212*a*, 212*b* of the base frame 212 are provided with bearing end portions 213*a*, 213*b*, respectively, which are turnably mounted on the shaft 204. The shaft 204 is provided with a sprocket wheel 214. Under the base frame 212 of the conveyer 201, there is provided a pneumatic cylinder 215 which is swingably supported by a supporting member 216 secured to the machine frame, and a plunger 217 of the pneumatic cylinder 215 is connected to the base frame 212. A shaft 218 is rotatably supported by a pair of bearings 219*a*, 219*b* rigidly mounted on the base frame 212 and a pair of pulleys 220*a*, 220*b* are secured to the shaft 218. A pair of endless belts 221*a*, 221*b* are mounted on the respective pairs of pulleys 207*a* and 220*a*, 207*b* and 220*b* so that the endless belts 221*a* and 221*b* provide means for carrying the protector plates 1 to either one of the conveyers 12 and 13. The conveyer 12 is mounted on a base frame 222 while the conveyer 13 is mounted on a base frame 223 which is disposed above the base frame 222 so that the conveyer 13 is superposed above the conveyer 12. At a position adjacent to the swingable conveyer 201, there are provided a pair of bearings 224*a*, 224*b* rigidly mounted on the base frame 222, and also a pair of bearings 224*a*, 224*b* rigidly mounted on the base frame 222, and also a pair of bearings 225*a*, 225*b* rigidly mounted on the base frame 223. A shaft 226 is turnably supported by the bearings 224*a*–*224b*, while a shaft 227 is turnably supported by the bearings 225*a* (225*b*), respectively. At a free end of the shaft 227, there is provided a sprocket wheel 228 which is driven by the sprocket wheel 214 by way of an endless chain 230. A sprocket wheel 213 is also mounted on the shaft 226. A sprocket wheel 232 is rigidly mounted on the shaft 226 in such a way that the sprocket wheel 232 is driven by the sprocket wheel 231 by way of an endless chain 233. The conveyer 13 is provided with a pair of endless belts 233*a*, 233*b* which are driven by pulleys 234*a*, 234*b* rigidly mounted on the shaft 227. The conveyer 12 is also provided with a pair of endless belts 235*a* (235*b*) driven by respective pulleys (not shown) rigidly mounted on the shaft 226. Therefore, the conveyers 12, 13 are always driven by the abovementioned power transmission mechanism. According to the motion of the plunger 217 of the pneumatic cylinder 215, the free end portion of the swingable conveyer 201, that is, the portion with the pulleys 220*a*, 220*b*, is capable of being positioned at the level of the carrying surface of either one of the conveyers 12, 13.

The protector plates 1 are alternatively displaced to the conveyer 12 or 13 in a group (wherein a plurality is received one after the other by one conveyer) or alternately according to the motion of the plunger 217 of the pneumatic cylinder 215. To carry out the distribution motion of the swingable conveyer 201 so as to distribute the protector plates 1 in a group onto either one of the conveyers 12, 13 it is proposed that a counting means such as a photoelectric counter, comprising a light projector and a photoelectric light receiver (not shown), be mounted on the conveyers 12, 13 so as to count the number of protector plates 1 which move therethrough. In this case a control circuit involving the conventional flip flop circuit is arranged in an electric connected between the detectors and the pneumatic cylinder and, consequently, when a predetermined number of the protector plates 1 pass through the photoelectric counter, the counter issues a signal to actuate the pneumatic cylinder 215 so as to change the carrying connection of the swingable conveyer 201 of the distribution conveyor 200 to the other conveyer 12 or 13.

Device for Changing the Carrying Direction of the Protector Plates

Figure 24:
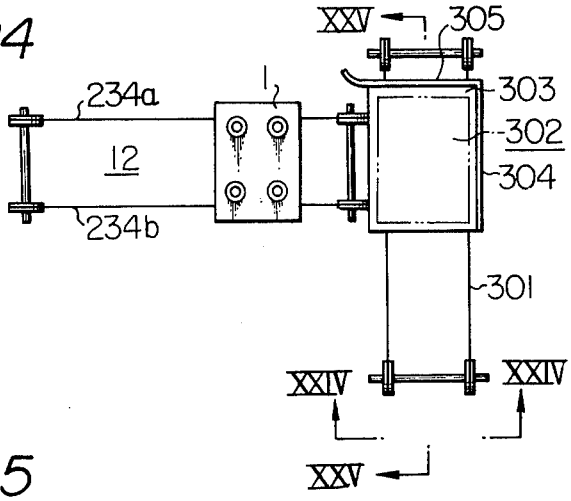
FIG. 24 is a plan view of a device for changing the carrying direction of the protector plate according to the present invention.
Figure 25:
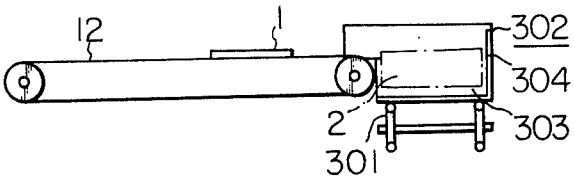
FIGS. 25 and 26 are an elevational view and a side view, respectively, of the device for changing the carrying direction of the protector plate shown in FIG. 24.
Figure 26:
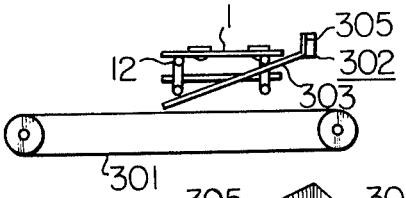
Figure 27:
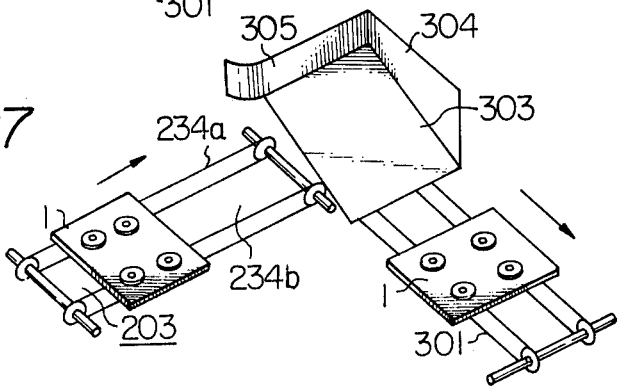
FIG. 27 is a perspective view of the device for changing the carrying direction of the protector plate shown in FIG. 24.

The protector plates 1 transferred to the conveyer 12 from the conveyer 11 by means of the distribution conveyer 200 are then carried to a device 300*a* for changing the carrying direction. The detailed construction of the device 300*a* is hereinafter explained in detail with reference to FIGS. 7, 24, 25, 26 and 27. The device 300*a* is provided with a discharge conveyer 301 and a chute member 302 disposed between the terminal of the conveyer 12 and a receiving terminal of the discharge conveyer 301 in such a way that the discharge terminal of the conveyer 12 is positioned at a higher level than the entrance of the chute member 302 and the discharge outlet of the chute member 302 is positioned at a higher level than the receiving terminal of the discharge conveyer 301. Further, the discharge conveyer 301 is disposed in such a condition that the carrying direction thereof is approximately 90° to the carrying direction of the conveyer 12. The chute member 302 comprises a sliding plate 303 and a pair of guide plates 304 and 305 which are projected upward from the sliding plate 303 in a rectangular relationship to each other as shown in FIGS. 24 and 27. The sliding plate 303 inclines downwards toward the discharge conveyer 301. When the protector plates 1 are transferred from the conveyer 12 to the chute member 302 by the inertia of the protector plate 1, each protector plate 1 contacts the guide plate 304 and is instantly stopped, and then slides on the sliding plate 303 towards the discharging conveyer 301 by its own weight. To ensure the abovementioned sliding motion of the protector plates 1 on the sliding plate 303 without any disturbance, the surface of the sliding plate 303 is made very smooth. After the protector plates 1 are transferred to the discharge conveyer 301, the protector plates 1 are carried to the reserve device 450 by way of an inclined conveyer 350*a* and a conveyer 400*a* as shown in FIG. 7. In the abovementioned embodiment, the discharge conveyer 301 has a construction similar to that of the conveyer 12. Therefore detailed illustration thereof is omitted.

Inclined Conveyer

The construction of the inclined conveyer 350*a* is hereinafter explained in detail with reference to FIGS. 28, 29 and 30. The inclined conveyer 350*a* comprises an inclined bottom conveyer 351 and an inclined top conveyer 360 which are disposed so as to carry the protector plates 1 in sandwiched condition between the bottom conveyer 351 and the top conveyer 360. The inclined bottom conveyer 351 comprises a pair of driving pulleys 352*a*, 352*b* rigidly mounted on a driving shaft 353 which is driven by a driving mechanism (not shown), a pair of pulleys 354*a*, 354*b* secured to a shaft 355 which is rotatably mounted on a machine frame (not shown), a pair of endless belts 356*a*, 356*b* mounted on the respective pairs of pulleys 352*a* and 354*a*, 352*b* and 354*b* in parallel condition to each other, and a plurality of pairs of guide pulleys 357*a*, 357*b* turnably mounted on respective shafts 358 in such a condition that these guide pulleys 357*a*, 357*b*guide the endless conveyer belts 356*a*, 356*b* respectively. The top conveyer 360 comprises a driving pulley 361 rigidly mounted on a driving shaft 362 which is driven by the same driving mechanism as the bottom conveyer 351, a pulley 363 turnably mounted on a shaft 364 secured to a machine frame (not shown), an endless conveyer belt 365 mounted on the pulleys 361 and 363, a plurality of guide pulleys 366 which guide the endless conveyer belt 365. The abovementioned plurality of pairs of guide pulleys 357*a*, 357*b* are arranged along the length of the conveyer 351 with a distance P therebetween, and the guide pulleys 366 are arranged along the conveyer 360 with an identical distance P therebetween. This distance P is selected so as to be of a smaller size when compared with a length $l$ of the protector plate 1. In this embodiment, the inclined angle of the top and bottom conveyers 360 and 351 in an identical angle $\theta°$. Further, the bottom surface of the top conveyer 360 projects slightly into the carrying surface of the bottom conveyer 351 at a position along a center line between the endless belts 356*a* and 356*b* as shown in FIG. 30. As the endless belts of the conveyers 351, 360 are driven toward the respective directions $X_1$, $X_2$ with the conveyer 36*s* projecting slightly into the center of conveyer 351's carrying surface, which is an inclined surface passing over the upper surfaces of endless belts 356*a* and 356*b*, the protector plates 1 carried on the inclined conveyer 350 are positively carried upwards.

Device for Turning Over the Protector Plates

The protector plates 1 carried to the conveyer 13 are then carried to a device 300*b* for changing the carrying direction, which has a construction similar to the device 300*a*, and then they are supplied to a device 330 for turning over them. The detailed construction of this turning-over device 330 is hereinafter explained in detail with reference to the drawings FIGS. 31, 32 and 33.

The turning over device 330 comprises an entrance conveyer 331 and a discharge conveyer 332 and a turning over guide member 333 disposed between the entrance conveyer 331 and the discharge conveyer 333 in such a way that the protector plates 1 carried by the entrance conveyer 331 are turned over by the guide member 333 before being transferred to the discharge conveyer 332. The entrance conveyer 331 comprises a pair of endless belts 334*a*, 334*b* mounted on a driving shafts 335 and a guide shafts 336 by way of the respective pulleys secured thereon in parallel condition, and the discharge conveyer 332 comprises a pair of endless belts 337*a*, 337*b* mounted on a driving shaft 333 and a guide shafts 339 by way of the respective pulleys secured thereon in parallel condition, as shown in FIG. 31. The turning over guide member 333 comprises a curved sliding plate 340 and a pair of guide plates 341*a*, 341*b* connected to the curved sliding plate 340. The sliding plate 340 is designed in the following manner. The distance *hl* between the sliding plate 340 and guide pulleys 336*a* secured to the shaft 336 satisfies the following relation to the length L of the protector plates 1, $L/2<hl$ L, and the distance between the guide pulleys 336*a* and the inside wall 340*a* of the sliding plate 340 gradually increases toward the discharge edge 340*b* of the sliding plate 340. The guide plates 341*a*, 341*b* prevent an irregular displacement of the protector plates 1 in biased condition. (FIG. 31)

When the protector plate 1 is displaced to the discharge terminal of the entrance conveyer 331, the preceding edge of the protector plate 1 first falls in the turning over guide member 333 as shown in FIG. 32. In this condition, the preceding edge of the protector plate 1 firstly contacts the sliding plate 340 and then slide toward the discharge edge 340*b* of the plates 340 as shown in FIG. 33. Consequently, the protector plate 1 is turned over and then transferred to the discharge conveyer 332 as shown in FIG. 33. The shape of the sliding plate 340 may be modified if the above-mentioned principle of turning over motion is satisfied.

In the above-mentioned embodiment, the protector plates 1 are simply turned over in a condition of changing the carrying direction toward opposite direction, however, in some cases it may be preferable to turn over the protector plates 1 in a condition of changing the carrying direction toward a right angle direction to the carrying direction of the entrance conveyer 331. If this latter method is preferred, as shown in FIG. 34, the discharge conveyer 332 is disposed below the entrance conveyer 331 in such a way that the carrying direction of the conveyer 332 is at a right angle to the carrying direction of the conveyer 331, and a sliding chute 312 having a construction similar to the guide member 303 of the device shown in FIG. 27 is disposed between the edge 340*b* of the sliding plate 340 and the discharge conveyer 332 in such a way that the chute 342 opens towards the edge 340*b* of the sliding plate 340 and the carrying direction of the conveyer 332. Therefore, if the turning over device 330 shown in FIG. 34 is utilized for the embodiment shown in FIG. 7, the device 300*b* and the entrance conveyer 331 can be omitted.

Device for Reserving Protector Plates

Figure 36:
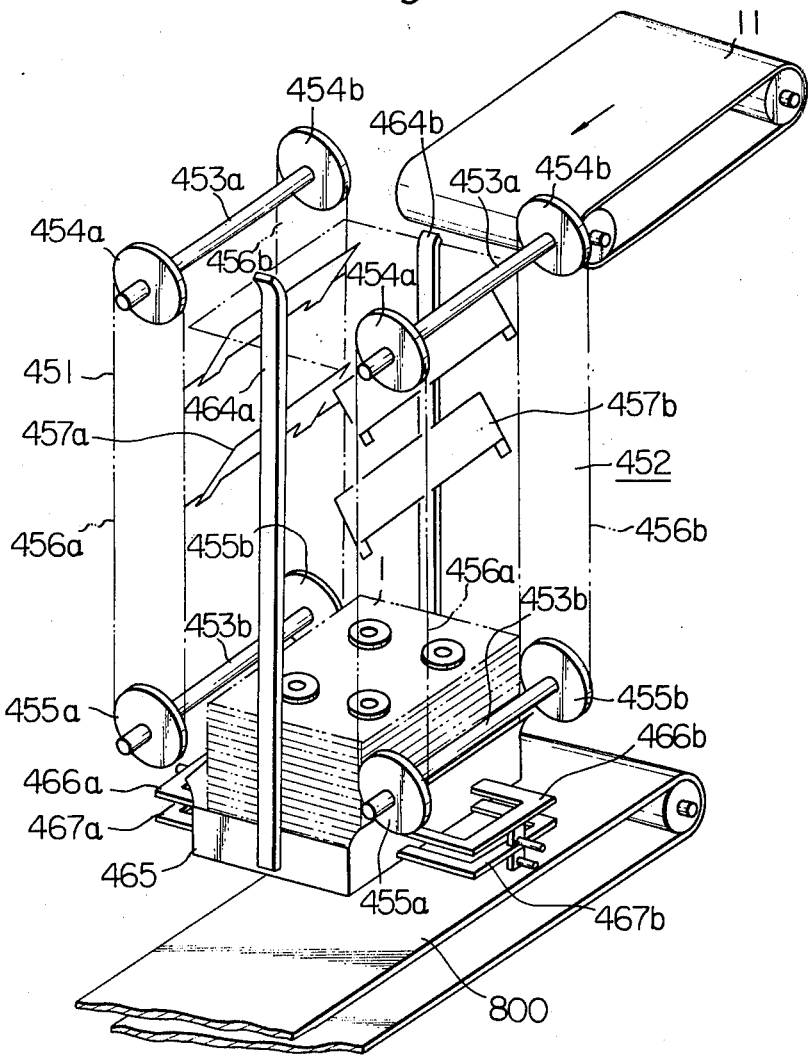
FIG. 36 is a schematic perspective view of the first protector plate reserving device shown in FIG. 35.
Figure 37:
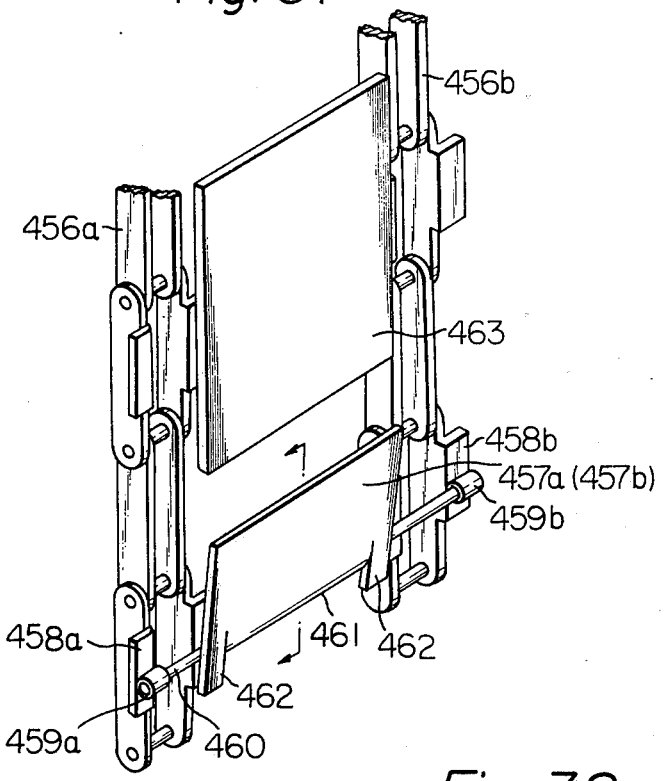
FIG. 37 is a perspective view of the supporting plate of the first protector plate reserving device shown in FIG. 35.
Figure 38:
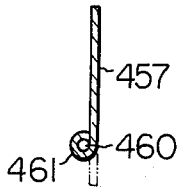
FIG. 38 is a side view of a part of the supporting plate shown in FIG. 37.

A device for reserving protector plates which has been disclosed in the specification of the Japanese Patent Publication Sho 48-16,273, is utilized as a first and second reserve device 450,500 in the above-mentioned embodiment. Therefore, the main construction and function of the reserving devices 450, 500 are only hereinafter illustrated. Referring to FIGS. 35, 36, 37 and 38, the protector plates reserving device 450 (FIG. 7) is provided with a pair of conveyers 451 and 452 arranged in parallel condition. These conveyers 451, 452 have identical constructions. The conveyer 451 comprises an upper shaft 453*a* and a lower shaft 453*b* disposed below the upper shaft 453*a* in parallel condition, a pair of sprocket wheels 454*a*, 454*b* rigidly mounted on end portions of the upper shaft 453*a*, a pair of sprocket wheels 455*a*, 455*b* rigidly mounted on the end portions of the lower shaft 453*b*, an endless chain 456*a* mounted on the sprocket wheels 454*a*, 455*a*, an endless chain 456*b* mounted on the sprocket wheels 454*b*, 455*b*, a plurality of supporting plates 457*a* turnably supported by the endless chains 456*a* and 456*b* are hereinafter illustrated in more detail. As the conveyer 452 has a construction similar to the conveyer 451, the similar elements are represented by identical numerals except for the supporting plates which are represented by the reference numeral 457*b*. Consequently, an explanation of the elements of the conveyer 452 is omitted. Referring to FIGS. 37 and 38, a pair of supporting pieces 458*a*, 458 *b* are rigidly mounted on chain blocks of the endless chains 456*a*, 456*b* which are facing each other, as shown in FIG. 37. The supporting pieces 458*a*, 458*b* are provided with bearings 459*a*, 459*b*, respectively, which support a horizontal shaft 460. The supporting plate 457*a* (457*b*) is provided with a pair of extended portions 462 formed at both end portions thereof and an intermediated edge portion having a bearing portion 461 formed between the extended portions 462. The bearing portion 461 is mounted on the shaft 460 so that the supporting plate 457*a* (457*b*) is capable of turning about the shaft 460, however, the extended portions 462 restrict the turning motion of the plate 457*a* (457*b*) toward the horizontal position thereof by contact with the supporting pieces 458*a*, 458*b*, respectively. Therefore, when the conveyers 451, 452 are driven, the supporting plates 457*a*, 457*b* are moved with the respective conveyers 451, 452 in the respective conditions of turning inwardly so that the protector plates 1 can be supported by the top edges of the supporting plates 457*a*, 457*b*. A guide member 463 is disposed at a position adjacently inside the conveyer 451, as shown in FIG. 35, and another guide member (not shown) is disposed at a position inside the conveyer 452 in a manner similar to the guide member 463, so as to position the protector plates 2 at a correct position to transfer into the reserve device. A pair of guide bars 464*a*, 464*b* are disposed between the endless chains 456*a* of the conveyers 451, 452, and between the endless chains 456*b* of the conveyers 451, 452 respectively so as to guide the protector plates 1 when they are displaced downward. At the bottom end of the reserve device 450, there is provided a box body 465 having an upright aperture which permits passing of the protector plates 1. A pair of upper stoppers 466*a*, 466*b* and a pair of lower stoppers 467*a*, 467*b* are slidably disposed in the box body 465 in such a way that the upper stoppers 466*a*, 466*b* and the lower stoppers 467*a*, 467*b* alternatively closed the above-mentioned upright aperture. When the protector plates 1 are supplied into the reserve device 450 from the conveyer 400*a* (400*b*), (See FIG. 7) each protector plate 1 is firstly positioned at a correct position regulated by the guide member 463, and then supported by the supporting plates 457*a*, 457*b* and displaced downward according to the downward displacement of the supporting plates 457*a*, 457*b*. The above-mentioned downward displacement of the supporting plates 457*a*, 457*b* is carried out by driving the conveyers 451, 452 in synchronous condition with the conveyer 400*a* (400*b*). According to the above-mentioned supply motion, the protector plates 1 are reserved in superposed condition from the bottom of the reserve device as shown in FIGS. 35 and 36. As the supporting plates 457*a*, 457*b* are capable of turning about the shaft 460 toward the endless chains 456*a*, 456*b*, the supporting plates 457*a*, 457*b* are capable of passing over the reserved supporting plates 1 at the bottom portion of the reserve device 450. When it is required to supply the protector plates 1 to the conveyer 800, in each unit operation, the upper stoppers 466*a*, 466*b* are firstly opened so as to deposite a protector plate 1 on the lower stoppers 467*a*, 467*b* which are maintained in closed condition, next the upper stoppers 466*a*, 467*a* are closed and thereafter the lower stopper 467*a*, 467*b* are opened so that the protector plate 1 supported by the lower stoppers 467*a*, 467*b* is dropped on the conveyer 800. The above-mentioned unit supply operation is repeated so as to supply the protector plates 1 to the conveyer 800. The second protector plate reserve device 500 has a construction and function similar to the first protector reserve device 450. Therefore, a detailed explanation of the second protector reserve device 500 is omitted.

A First Film Supply Device

When the protector plate 1 is supplied to the assembling line for making the unit package, the first protector plate 1*a* is firstly covered with a sheet of film in such a way that a sheet of film is disposed on the first protector plate 1*a*. This operation is carried out by a device 550 for supplying a sheet of film. The construction and function of the device 550 is hereinafter explained in detail with reference to FIGS. 39 through 43G.

At the working position of the device 550 (FIG. 7), there is provided a pair of stoppers 551*a*, 551*b* rigidly connected to plunger of pneumatic cylinders 552*a*, 552*b*, respectively, mounted on the machine frame of the device 550. A limit switch 553 rigidly supported by the machine frame of the device 550 in such a way that the limit switch 553 is actuated by a first protector plate 1*a* carried by the conveyer 800. The limit switch 553 actuates the pneumatic cylinders 552*a*, 552*b* so as to project the stoppers 551*a*, 551*b* toward the carrying passage of the protector plate 1*a* so as to stop further displacement of the plate 1*a* until the supply motion of a sheet of film is completed. (FIGS. 39, 40).

Figure 39:
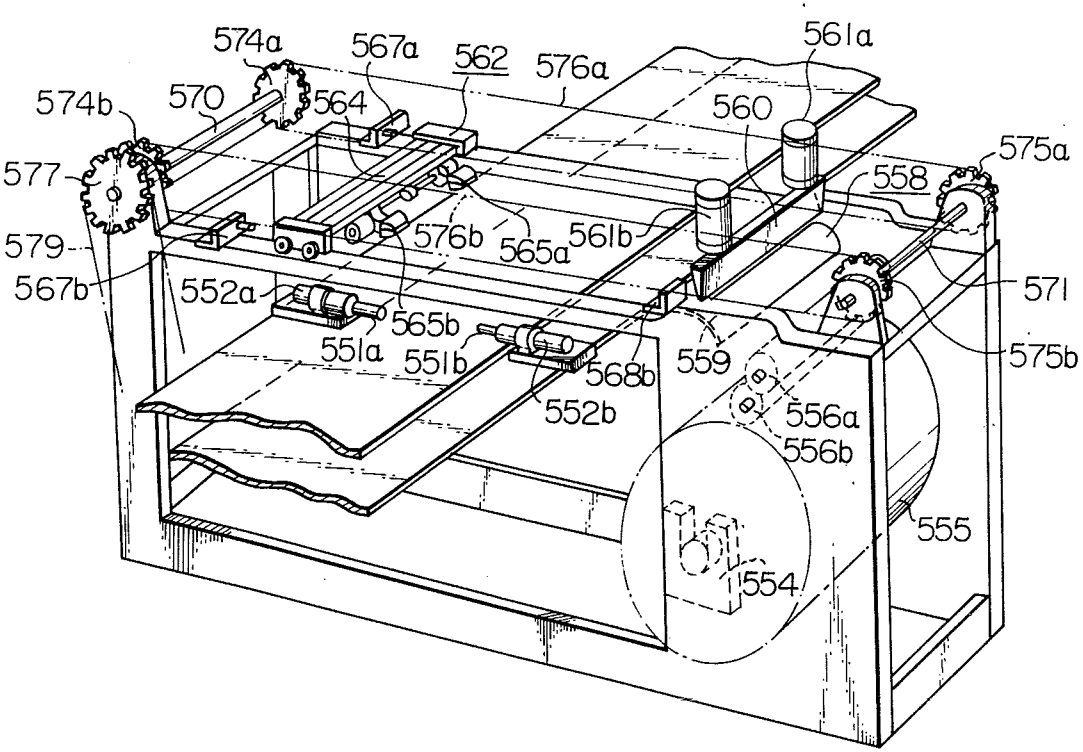
FIG. 39 is a perspective view of a first-film supply device according to the present invention.
Figure 40:
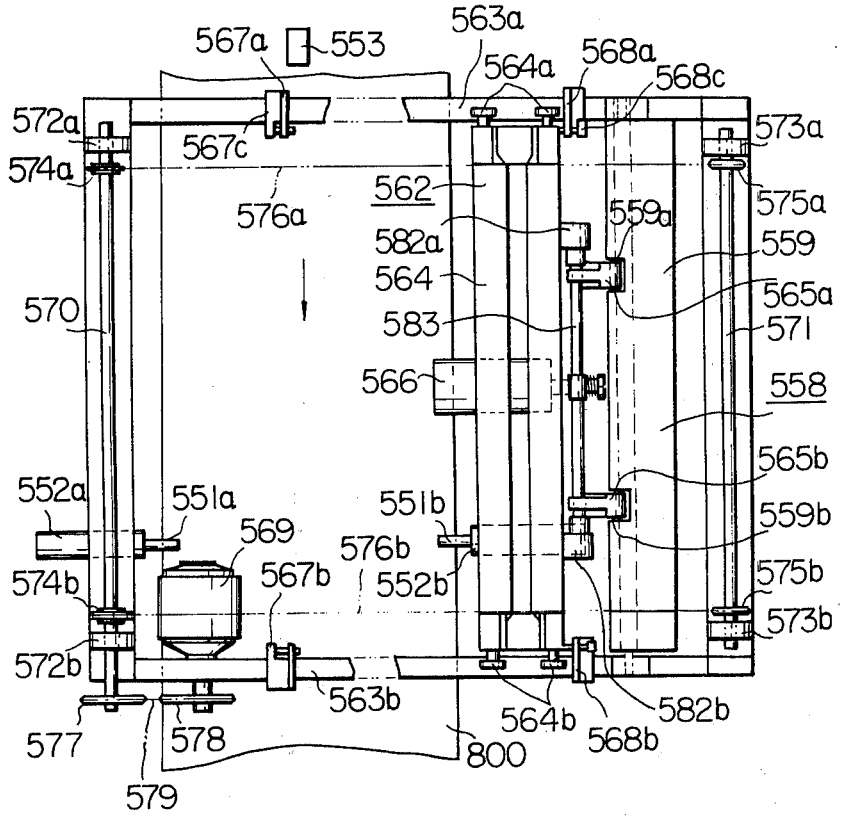
FIG. 40 is a schematic plan view, partly omitted, of the first-film supply device shown in FIG. 39.

As shown in FIGS. 39, 40, the device 550 is disposed along the conveyer 800 in transversely superposed condition, that is, the film supplying direction transversely crosses the carrying direction of the protector plate 1*a* by the conveyer 800. The device 550 comprises a supporting device 554 for turnably supporting a roll film magazine 555, a pair of guide rollers 556*a*, 556*b* which define a supply passage of a sheet of film 6*a* from the magazine 555, a cutting device 558, a carrying device 562 for gripping an edge portion of the film 6*a* and for carrying the edge portion to a predetermined position outside the conveyer 800, a driving mechanism for driving the carrying device 562, and an electrical control mechanism (not shown) for controlling the actions of the above-mentioned elements.

Figure 41A:
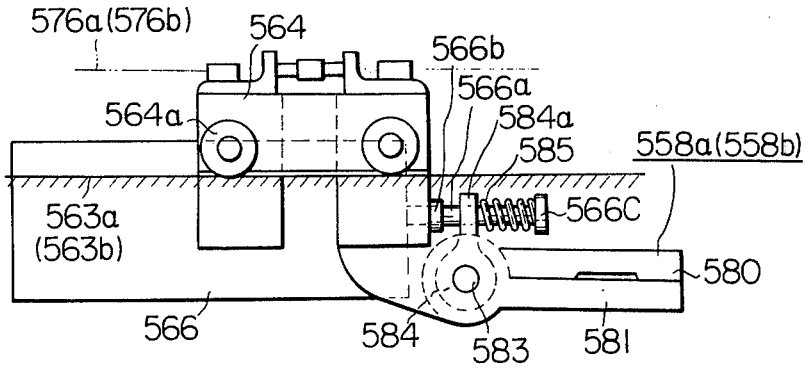
FIGS. 41A and 41B are side views of a clamp holding bar and a clamp utilized for the first-film supply device shown in FIG. 39.
Figure 41B:
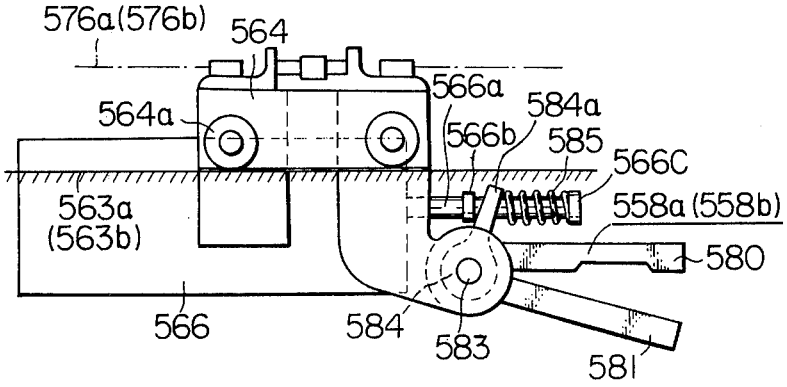
Figure 42:
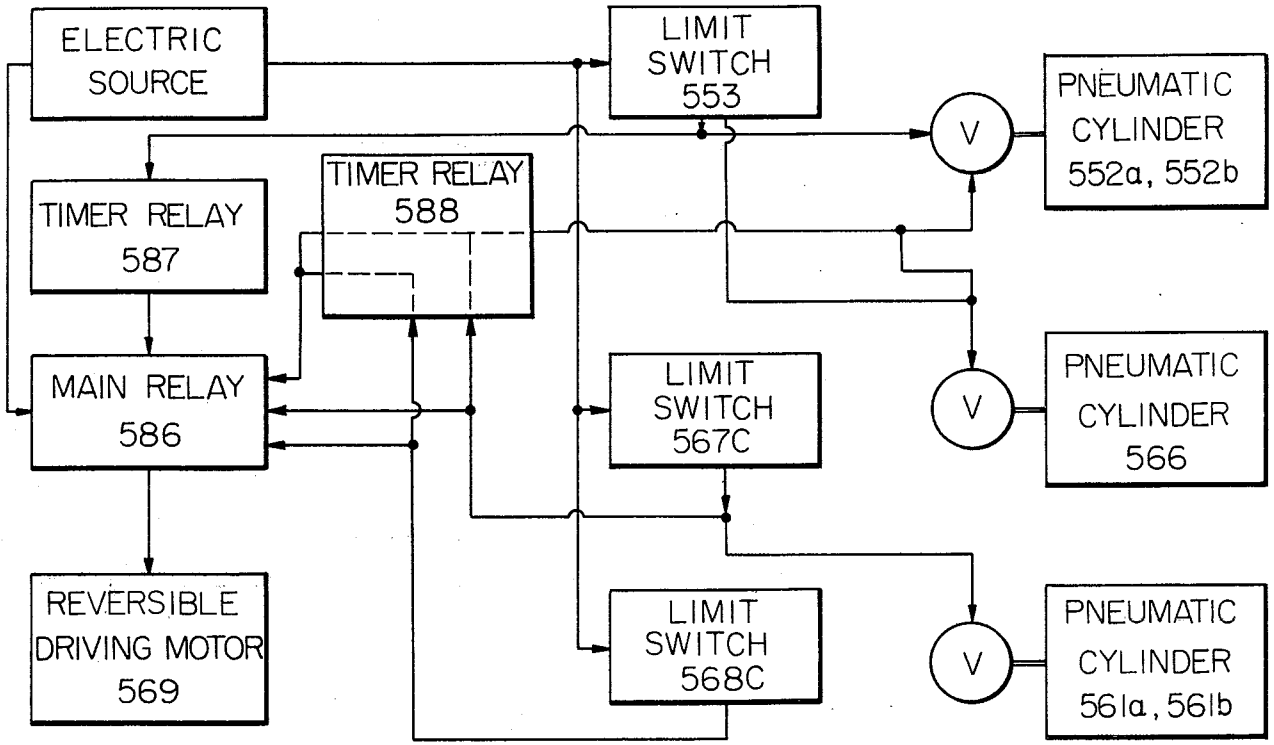
FIG. 42 is a block diagram of the control mechanism of the first-film supply device shown in FIG. 39.

The supporting device 554 has a construction quite similar to a device for supporting a rolled sensitive paper which is utilized for the conventional electrocopying machine. Therefore, the detailed explanation thereof is omitted. The take-up rollers 556*a*, 556*b* are covered with synthetic rubber material and are capable of being turned negatively by the frictional contact with the film 6*a* at the nip line thereof formed therebetween. The above-mentioned driving mechanism is capable of being intermittently driven by a motor (not shown) as hereinafter explained in detail. The cutting device 558 comprises an anvil 559 stationarily mounted on the frame of the device 550 and a cutting knife 560 which is capable of being actuated by a pair of pneumatic cylinders 561*a*, 561*b*. When the pneumatic cylinders 561*a*, 561*b* are actuated, the cutting knife 560 is urged to the anvil 559. The anvil 559 is provided with a pair of cut-off portions 559*a*, 559*b*. The carrying device 562 comprises a pair of guide rails 563*a*, 563*b* mounted on the frame of the device 550 in parallel condition with an interval which is larger than the width of the film 6*a*, a clamp holding bar 564 being capable of reciprocally displacing along the guide rails 563*a*, 563*b*, and a driving mechanism for driving the clamp holding bar 564. The clamp holding bar 564 is provided with a pair of rollers 564*a*, 564*b* turnably mounted to both sides thereof. The clamp holding bar 564 is provided with a pair of clamp means 565*a*, 565*b* and a pneumatic cylinder 566 which opens or closes the clamp means 565*a*, 565*b* as hereinafter explained in detail. Two pairs of stoppers 567*a*, 567*b*, 568*a*, 568*b* are mounted on the guide rails 563*a*, 563*b* at the terminal positions of the reciprocal displacing motion of the clamp holding bar 564 so as to restrict the stroke of the reciprocal displacing motion of the clamp holding bar 564 as shown in FIGS. 39 and 40. The stoppers 567*a*, 568*a* are connected to the respective limit switches 567*c*, 568*c*. The driving mechanism of the clamp holding bar 564 comprises a reversible driving motor 569 mounted on the frame of the device 550, a pair of horizontal shaft 570, 571 turnably supported by bearings 575*a* and 572*b*, 573*a* and 573*b* mounted on the end frames of the device 550, a pair of sprocket wheels 574*a*, 574*b* rigidly mounted on the horizontal shaft 570, a pair of sprocket wheels 575*a*, 575*b* rigidly mounted on the shaft 571, endless chains 576*a*, 576*b* mounted on the sprocket wheels 574*a* and 575*a*, 574*b* and 575*b*, respectively, a sprocket wheel 577 rigidly mounted on the shaft 570 at the end portion thereof, a sprocket wheel 578 rigidly mounted on a shaft of the motor 569, and an endless chain 579 mounted on the sprocket wheels 577 and 578. The above-mentioned endless chains 576*a* and 576*b* are connected to both edges of the clamp holding bar 564. Consequently, the clamp holding bar 564 is reciprocally driven by the driving of the endless chains 576*a*, 576*b* which are driven by the driving motor 569, in such a way that, when the clamp holding bar 564 contacts with the stopper 567*a*, 567*b* and the stopper 567*a* actuates the limit switch 567*c*, the motor 569 is stopped so that the taking up motion of the film 6*a* from the magazine 555 is stopped, and then the motor 569 is driven in a rotational direction which is reverse to the previous rotational direction thereof. When the clamp holding bar 564 contacts with the stopper 568*a*, 568*b*, so that the stopper 568*a* actuates the limit switch 568*c*, the motor 569 is stopped and after a predetermined time which is necessary for clamping a fresh edge of the film 6*a*, the motor 569 is driven in a rotational direction which is reverse to a direction of the previous rotation thereof as hereinafter illustrated in more detail. In the above-mentioned operation, the conventional delay timer switches are utilized for controlling the delayed actions. The clamping means 565*a* (565*b*) comprises an upper clamp jaw 580 and a lower clamp jaw 581. They are capable of occupying the respective spaces formed by the cut-off portions 559*a*, 559*b* when the clamp holding bar 564 is stopped at a starting position adjacent to the cutting knife 560. The upper clamp jaws 580 are rigidly held by a pair of brackets 582*a*, 582*b* secured to the clamp holding bar 564. A horizontal shaft 583 is turnably held by the brackets 582*a*, 582*b* and a collar piece 584 is rigidly mounted on the shaft 583 at a position facing the pneumatic cylinder 566. The collar piece 584 is provided with a projection 584*a*. A plunger 566*a* of the pneumatic cylinder 566 passes through an aperture (not shown) formed in the projection 584*a* and a pair of collar pieces 566*b*, 566*c* are rigidly mounted on the plunger 566*a* in such a way that the projection 584*a* of the collar piece 584 is positoned between the collar pieces 566*b* and 566*c*. A helical expansion spring 585 is mounted on the plunger 566*a* at a position between the collar piece 566*c* and the projection 584*a* of the collar piece 584. The lower clamp jaws 581 are rigidly mounted on the shaft 583 at the respective positions facing the upper clamp jaws 580 as shown in FIGS. 40, 41A and 41B. Therefore, when the pneumatic cylinder 566 is actuated, the plunger 566*a* is projected from the cylinder 566 so that the lower clamp jaw 581 is turned as shown in FIG. 41B, in other words, the clamp means 565*a* (565*b*) are opened. However, when the pneumatic cylinder 566 is de-energized, the plunger 566*a* is retracted into the cylinder 56 so that the lower clamp jaw 581 is urged by the spring force created by the helical spring 585 as shown in FIG. 41A.

Figure 43A:
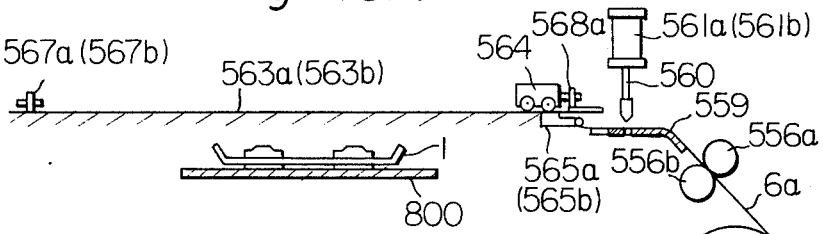
FIGS. 43A, 43B, 43C, 43D, 43E, 43F and 43G are schematic side views of main parts of the first-film supplying device shown in FIG. 39, in operational conditions.
Figure 43B:
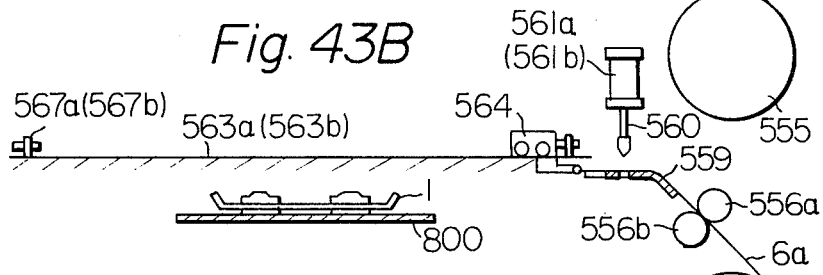

The above-mentioned elements of the device 550 are operated in relatively controlled condition. Referring to FIGS. 42, 43A through 43G, when the limit switch 553 detects the arrival of a protector plate 1, the limit switch 553 issues a signal to actuate the pneumatic cylinders 552*a*, 552*b* and a main relay 586 (FIG. 42) which comprises a pair of relays for changing the polarity of the input of the reversible motor 569 by way of a timer relay 587 (FIG. 42) and a neutral relay which disconnects the electric source with the motor 569. When the pneumatic cylinders 552*a* (552*b*) are actuated, the stoppers 551*a* (551*b*) are projected from the respective cylinders 552*a* (552*b*) so that the first protector plate 1*a* is stopped at a predetermined position for receiving a sheet of film 6*a*. In this condition, the clamp holding bar 564 is positioned at its starting position adjacent to the anvil 559 where the clamp means 565*a*, 565*b* occupy the respective spaced formed by the cut-off portions 559*a*, 559*b* of the anvil 559 in opened condition, and the cutting knife 560 is positioned above the anvil 559. This condition is shown in FIG. 43A. The pneumatic cylinder 566 is also actuated by the signal of the limit switch 553 so that the clamp means 565*a*, 565*b* are closed, in other words, the end portion of the film 6*a* is gripped by the clamp means 565*a*, 565*b*. This condition is shown in FIG. 43B.

Figure 43C:
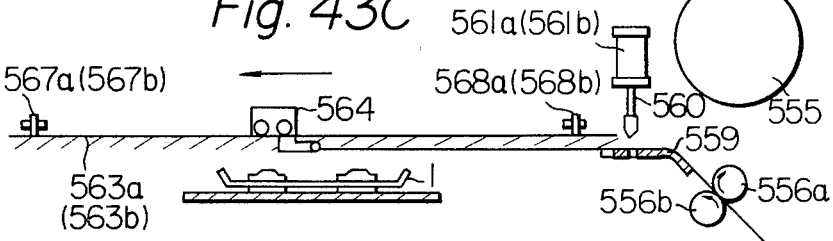

When the timer relay 587 actuates, the relay 586 connects the electric source with the motor 569 in plus polarity fashion, the motor 569 is driven so that the clamp holding bar 564 is displaced toward the stopper 567*a*, 567*b* along the guide rails 563*a*, 563*b* by way of the above-mentioned driving mechanism provided with the endless chains 576*a*, 576*b*. This condition is shown in FIG. 43C. According to the above-mentioned displacement of the clamp holding bar 564, the film 6*a* is taken-up from the magazine 555 by way of the rollers 556*a*, 556*b* and the anvil 559.

Figure 43D:
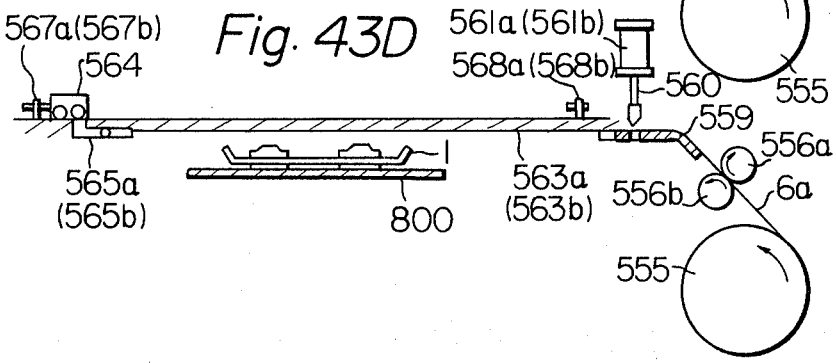

When the clamp holding bar 564 contacts the stopper 567*a* (567*b*) so that the limit switch 567*c* is actuated, the limit switch 567*c* actuates the main relay 586 to change the neutral disconnecting condition where the drive motor 569 is disconnected from the electric source. This condition is shown in FIG. 43D. According to the above-mentioned displacement of the clamp holding bar 564, a film 6*a* having a predetermined length is introduced above the first protector plate 1*a*.

Figure 43E:
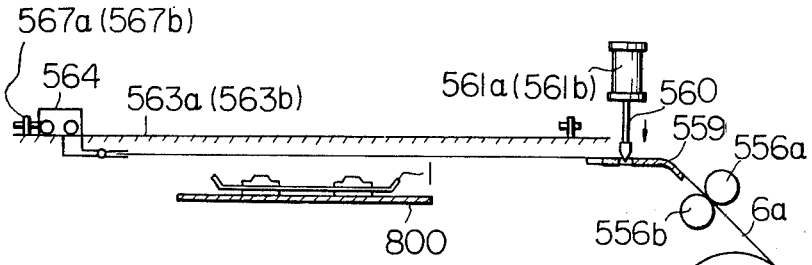

The pneumatic cylinders 561*a*, 561*b* are temporarily energized by the signal issued from the limit switch 567*c*, so that the cutting knife 560 is urged to the anvil 559 and then returned to its waiting position above the anvil 559. According to the above-mentioned motion, a sheet of film 6*a* having a predetermined length is separated from the roll of film held by the magazine 555. This condition is shown in FIG. 43E.

Figure 43F:
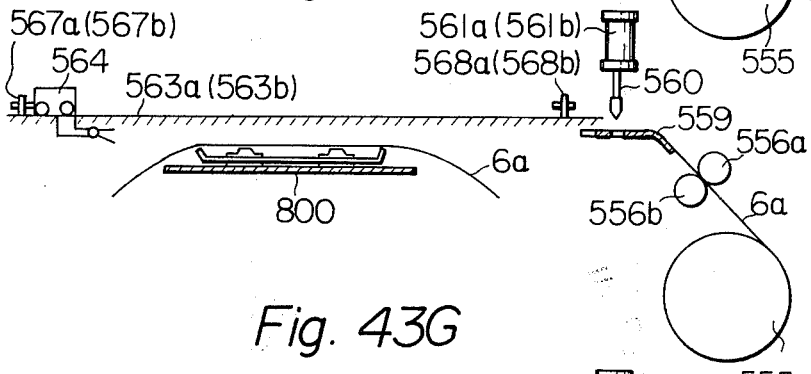

The pneumatic cylinder 556 is de-energized by the signal issued from the limit switch 567*c* after a predetermined short time controlled by a timer relay 588 and therefore, the clamp means 565*a*, 565*b* are opened, so that the sheet of film 6*a* is dropped on the first protector plate 1 as shown in FIG. 43F.

Figure 43G:
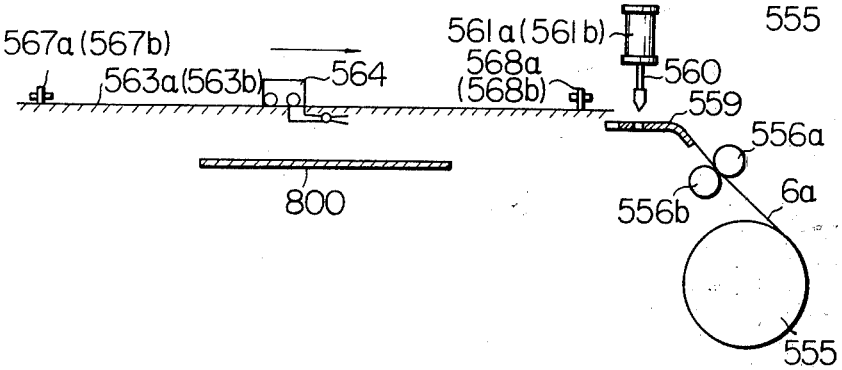

The timer relay 588 issues a signal to actuate the main relay 586 so as to change the connection between the motor 569 with the electric source in minus polarity fashion from the neutral disconnecting condition. Therefore, the motor 569 is driven in a direction which is reverse to the driving direction when the clamp holding bar 564 is displaced toward the stoppers 567*a*, 567*b*. In other words, the clamp holding bar 564 is displaced toward the stopper 568*a*, 568*b* along the guide rails 563*a*, 563*b*. In this condition, the pneumatic cylinders 552*a*, 552*b* are de-energized by the signal issued from the timer relay 588 so that the first protector plate 1*a* covered with a sheet of film 6*a* is displaced to the downstream position of the conveyer 800. This condition is shown in FIG. 43G.

When the clamp holding bar 564 contacts with the stoppers 568*a*, 568*b*, the limit switch 568*c* issues a signal to actuate the main relay 586 so as to change the connection between the motor 569 and the electric source to the neutral disconnecting condition which is the starting condition of the above-mentioned operations. In the above-mentioned embodiment, each pneumatic cylinder is a conventional one which is actuated by compressed air. Consequently, a two way magnet valve connecting the supply source of compressed air with two chambers intervened by a piston connected to a plunger, is utilized for the present invention. Therefore, the pneumatic cylinder is actuated by the above-mentioned two way magnet valve by an electric signal issued from the respective limit switches.

Device for Positioning a Protector Plate at a Desired Position

Figure 44:
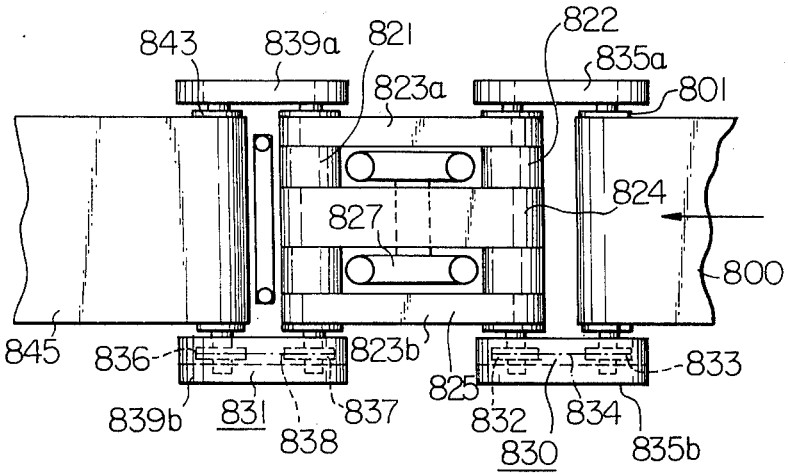
FIG. 44 is a plan view of a device for positioning a first protector plate at a desirable position according to the present invention.
Figure 45:
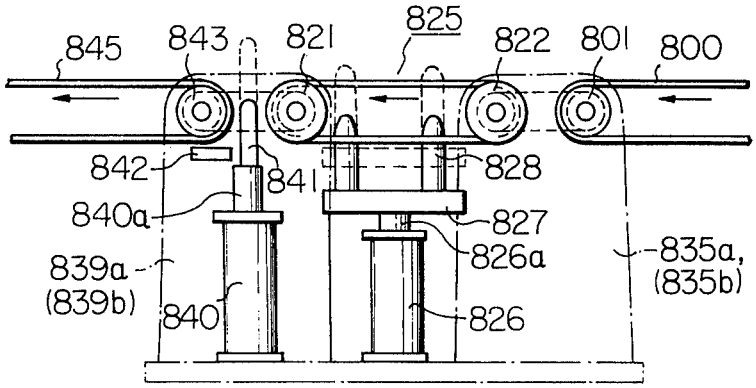
FIG. 45 is a schematic side view of the positioning device shown in FIG. 44.
Figure 46:
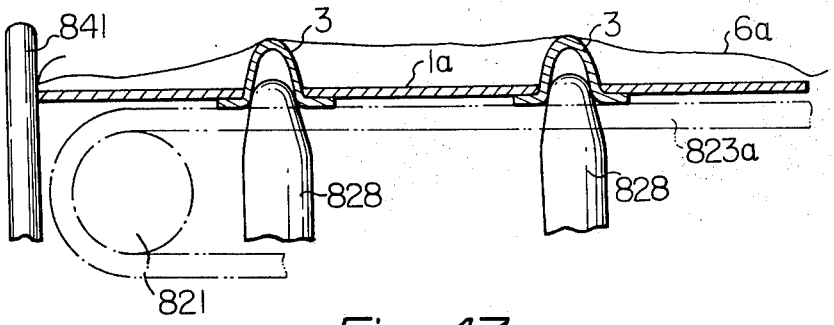
FIG. 46 is a schematic side view of a part of the positioning device shown in FIG. 44.
Figure 47:
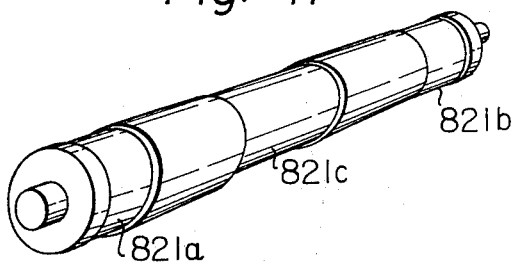
FIG. 47 is a perspective view of a guide roller of a conveyer shown in FIG. 44.

Referring to FIG. 7, when the first protector plates 1*a* covered with a film 6*a* is delivered from the working position of the film supply device 550 by the conveyer 800, the first protector plate 1*a* is then transferred to a next conveyer 825 which is capable of temporarily positioning the first protector plate 1*a* at a predetermined position where a plurality of yarn packages are mounted on the first protector plate 1*a* covered with the film 6*a*. For the sake of simplifying the following explanation, the above-mentioned predetermined position is hereinafter referred to as an assembling position. Referring to FIGS. 44, 45, 46 and 47 the conveyer 825 is provided with a pair of guide rollers 821, 822. The rollers 821, 822 have the same construction. Therefore, only the construction of the roller 821 is illustrated. The roller 821 is provided with a pair of guide grooves 821*a*, 821*b* formed at both end portions thereof and a central groove 821*c* formed at a position between the guide grooves 821*a*, 821*b* as shown in FIG. 47. A pair of endless belts 823*a*, 823*b* mounted on the rollers 821, 822 in such a condition that these belts 823*a*, 823*b* ride on the above-mentioned guide grooves 821*a*, 821*b* of the roller 821, and the corresponding guide grooves of the roller 822. An intermediate endless belt 824 is mounted on the rollers 821, 822 in such a way that the endless belt 824 ride on the guide groove 821*c* of the roller 821 and the corresponding intermediate groove of the roller 822, as shown in FIG. 44. Therefore, a pair of spaces are formed between the endless belts 823*a* (823*b*) and 824. A pneumatic cylinder 826 is provided at a position below the conveyer belt 824, and a horizontal bracket 827 is rigidly mounted on a plunger 826*a* of the pneumatic cylinder 826. Four pegs 828 are rigidly mounted on the horizontal bracket 827 in such a condition that the relative arrangement of these pegs 828 coincide with the relative arrangement of the holding caps 3 of the protector plate 1*a*. And the arrangement of the guide grooves of the roller 821, 822 is so designed that the above-mentioned intermediate spaces between the endless belts 823*a* and 824, and the endless belts 823*b* and 824 permit passing of the above-mentioned pegs 828 to a position beyond the upper surfaces of these endless belts 823*a*, 823*b* and 824. At a position adjacently downstream the conveyer 825, there is provided a third conveyer 845. These conveyers 800, 825 and 845 are synchronously driven by means of a pair of power transmission mechanisms. That is, the driving of the conveyer 800 is transmitted to the conveyer 825 by a first power transmission mechanism 830, while the driving of the conveyer 825 is transmitted to the conveyer 845 by a second power transmission mechanism 831 as shown in FIG. 44. The first power transmission mechanism 830 comprises a pair of sprocket wheels 832, 833 rigidly mounted on the shaft of the guide roller 822, and a shaft of a guide roller 801 which guides the conveyer belt of the conveyer 800, and an endless chain 834 which transmits the driving power of the sprocket wheel 833 to the sprocket wheel 832. The shafts of these rollers 801, 822 are turnably supported by the respective bearings (not shown) mounted on a pair of supporting brackets 835*a*, 835*b*. The second power transmission mechanism 831 has a construction similar to the first power transmission mechanism 830. Therefore, the reference numerals of the elements are only illustrated as follows, that is, a guide roller 843 of the conveyer 845, sprocket wheels 836, 837 mounted on the shafts of the rollers 843, 821 respectively, an endless chain 838 connecting the sprocket wheels 836, 837, and a pair of brackets 839*a*, 839*b*. A pneumatic cylinder 840 is disposed at a position below an intervened space between the conveyers 845 and 825, and a stopper 841 is rigidly mounted on a plunger 840*a* of the pneumatic cylinder 840 as shown in FIG. 45. The stopper 841 is capable of projecting beyond the carrying surface of the conveyers 810, 825 by actuating the penumatic cylinder 840. Therefore, when the stopper 841 is projected beyond the carrying surface of the conveyers 845, 825, the first protector plate 1*a* contacts the stopper 841 so that the protector plate 1*a* is stopped. The relative distance between the pneumatic cylinders 840 and 826 is designated in such a way that when the protector plate 1*a* is stopped by the stopper 841, and when the pegs 828 are displaced upward, these pegs 828 are capable of engaging into the corresponding holding caps 3 of the first protector plate 1*a*. The stopper 841 is actuated by the signal issued from the limit switch 568*c* of the previous device 550 for supplying the film 6*a* on the first protector plate 1*a*. A limit switch 842 is disposed at a position below the conveyer 845 in such a condition that the limit switch 842 is capable of being actuated by the plunger 840*a* when the pneumatic cylinder 840 is actuated so as to project the stopper 841. The pneumatic cylinder 826 is actuated by a signal issued from the limit switch 842. It is preferable to apply a delay timer in an electric circuit betwen the limit switch 842 and a control valve (not shown) of the pneumatic cylinder 826. As mentioned above, when the film supplying motion by the device 550 is completed, the first first protector plate 1*a* is displaced to the positioning conveyer 825. As the limit switch 568*c* of the previous device 550 issues a signal to actuate the penumatic cylinder 840, the stopper 841 is projected beyond the carrying surfaces of the conveyers 825 and 845 so that the protector plate 1*a* is stopped by contacting the stopper 841. Thereafter, the pneumatic cylinder 826 is actuated by the signal issued from the limit switch 842 so that the pegs 828 engage with the corresponding holding caps 3 of the first protector plate 1*a* stopped by the stopper 841. According to the above-mentioned motion, the first protector plate 1*a* is capable of stopping at a predetermined position upon the conveyer 825, as shown in FIG. 46.

An Automatic Device for Assembling Full Yarn Packages with the First Protector Plate After completion of the inspection test, the yarn packages 4 are reserved at a position for assembling with the first protector plate 1*a*, and, then, they are mounted on the corresponding holding caps 3 of the first protector plate 1*a* positioned at a predetermined position of the conveyer 825 (FIG. 7). The above-mentioned operation may be carried out manually, however, in the following illustration, automatic devices are used for carrying out the above-mentioned operation. That is, the following illustration discloses a device for preparatorily holding a plurality of yarn packages 4 in upright condition and a device for taking the yarn packages from the preparatorily holding device and for mounting these yarn packages 4 on the corresponding holding caps 3 of the the first protector plate 1*a* in such a way that the holding caps 3 are inserted into the corresponding bobbins of the yarn packages 4.

Figure 48:
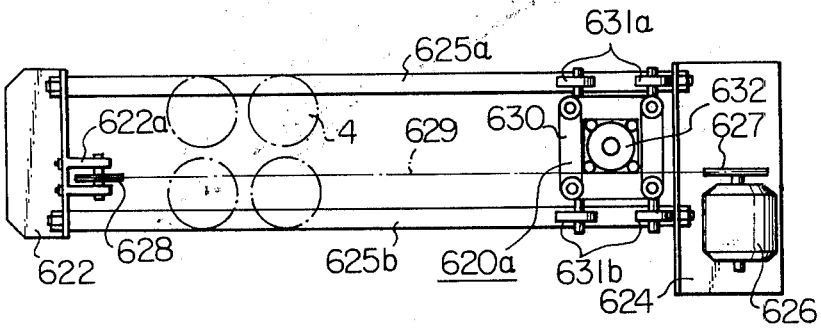
FIG. 48 is a plan view of a device for assembling a plurality of yarn packages on the first protector plate according to the present invention.
Figure 49:
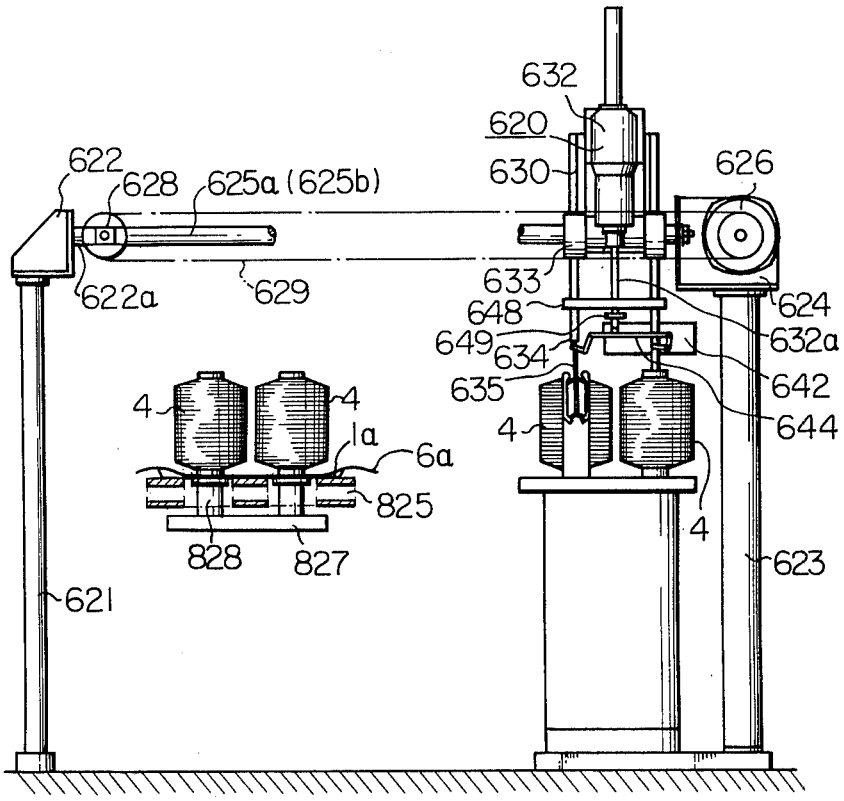
FIG. 49 is a schematic side view of the assembling device shown in FIG. 48.
Figure 50:
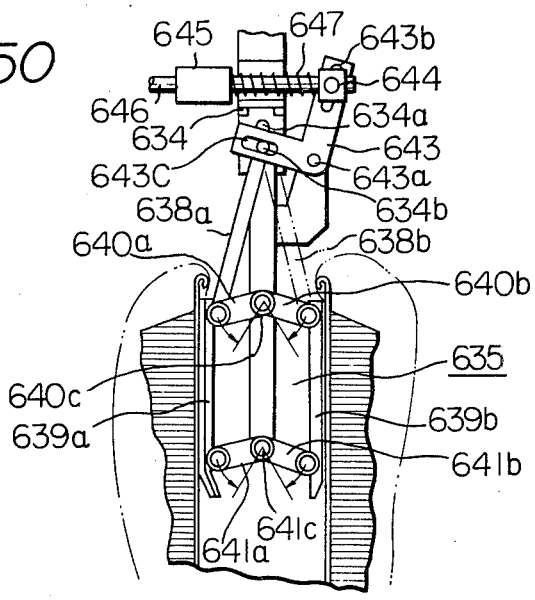
FIG. 50 is a side view of a gripping member of the assembling device shown in FIG. 48.

Referring to FIGS. 48, 49 and 50, the assembling device 600 for transferring the yarn packages 4 from the waiting position, where a predetermined number of yarn packages 4 have been previously reserved, to a first protector plate 1*a*, is now explained in detail. The assembling device 600 comprises a first supporting member 621 and a second supporting member 623 rigidly mounted on the floor in such away that the conveyer 825 is positioned between these supporting members 621 and 623. A first supporting bracket 622 is mounted on a top end of the first supporting member 621 and a second supporting bracket 624 is mounted on a top end of the second supporting member 623. An auxiliary bracket 622*a* is projected from the bracket 622 and a sprocket wheel 628 is turnably supported by the bracket 622*a*. A motor 626 is mounted on the bracket 624, a sprocket wheel 627 is rigidly mounted on a shaft of the motor 626, and an endless chain 629 is mounted on the sprocket wheels 627 and 628.

A pair of guide rails 625*a* and 625*b* are rigidly supported by the brackets 622 and 624. A yarn package transferring member 620*a* is provided with a base frame 630 and two pairs of wheels 631*a*, 631*b* turnably mounted to the base frame 630 in such a condition that these wheels 631*a*, 631*b* are capable of capable of rolling on the guide rails 625*a*, 625*b*. The transferring member 620*a* comprises a pneumatic cylinder 632 mounted on the base frame 630 and four guide members 633 which are symmetrically mounted to the base frame 630 with respect to the central axis of the pneumatic cylinder 632 in upright condition. An upright rod 634 is slidably supported by each guide member 633, and a gripping member 635 is mounted to a lower end of the upright rod 634. Each gripping member 635 comprises a pair of link lever 638*a*, 638*b* which are turnably supported by a pin 634*b* slidably mounted on a slot 634*a* formed in the upright rod 634, a pair of link levers 640*a*, 640*b* which are turnably mounted on a pin 640*c* secured to the upright rod 634, a pair of link levers 641*a*, 641*b* which are turnably mounted on a pin 641*c* secured to a lower end portion of the upright rod 634, a pair of clamp pieces 639*a*, 639*b* which are pivotably mounted on the respective link levers 640*a*, and 641*a*, 640*b* and 641*b*, respectively. The bottom end portion of the link levers 638*a*, 638*b* are also pivotably connected to the corresponding pivots which connect the clamp pieces 639*a* with the lever 640*a*, and the lever 639*b* with the lever 640*b*, respectively. The pneumatic cylinder 632 is provided with a plunger 632*a*. An auxiliary bracket 642 is mounted on the frame of the device 620 at a position above the pin 634*b*. An L-shaped lever 643 is turnably mounted on a supporting pin shaft 643*a* secured to the bracket 642, and the upper end portion thereof is provided with a slot 643*b* where a horizontal rod 644 passes through. The rod 644 is connected to a bottom end portion of the plunger 632*a*. Therefore, the L-shaped lever 643 is turned about the pin 643*a* according to the motion of the plunger 632*a*. A supporting bracket 645 is mounted to the bracket 642, and a horizontal rod 646 is slidably supported by the supporting bracket 645. The horizontal rod 646 is provided with a slot (not shown) formed at an end portion thereof and the rod 644 passes through the above-mentioned slot. An expansion spring 647 is mounted on the rod 646 at a position between the bracket 645 and the rod 644 so that the L-shaped lever 643 is always forced to turn clockwise in FIG. 48. A horizontal plate 648 is rigidly supported by the upright rods 635 and the horizontal plate 648 is provided with an aperture (not shown) where the plunger 632*a* passes through. A stopper 649 is secured to the plunger 632*a* at a position adjacently below the horizontal plate 648 as shown in FIG. 49. In this embodiment, the transferring member 620*a* is capable capable of stopping at a position right above the waiting position in such a condition that the gripping members 635 are capable of being inserted into bobbins of the yarn packages 4 which are reserved at the waiting position in upright condition. Consequently, when the pneumatic cylinder 632 is actuated so as to lower the plunger 632*a* toward the yarn packages 4 reserved at the waiting position, the gripping members 635 are inserted into the bobbins 4*a* of the above-mentioned yarn packages 4 in such a condition that the clamp pieces 639*a*, 639*b* are displaced inward according to the clockwise turning motion of the L-shaped lever 643. When the plunger 632*a* of the pneumatic cylinder 632 is pulled upward, the L-shaped lever 643 is firstly turned counterclockwise about the pin 643*a* so that the clamp pieces 639*a*, 639*b* are displaced toward the inside wall of the bobbin 4*a* of the yarn package 4 so that the yarn package 4 is stably gripped by the clamp pieces 639*a*, 639*b*. Then, according to the further upward movement of the plunger 632*a*, the stopper 649 urges the horizontal plate 648 upward so that the yarn packages 4 are displaced upward by the upward m motion of the plunger 632*a* from the waiting position.

The base frame 630 of the yarn package transferring member 620*a* is capable of displacing along the guide rails 625*a*, 625*b* actuating the motor 626. The motor 626 is a reversible motor and a pair of stoppers (not shown) are mounted on the guide rail 625*a* so as to restrict the stroke of the reciprocal displacing motion of the base frame 630. A pair of limit switches (not shown) are mounted on the respective brackets (not shown) of the above-mentioned stoppers in such a condition that, when the base frame 630 contacts with the above-mentioned stopper which is positioned above the conveyer 820, the limit switch (hereinafter referred to as a first limit switch) issues a signal to stop the motor 626, and to actuate the pneumatic cylinder 632 so as to transfer the yarn packages 4 from the gripping members 635 to the corresponding holding caps 3 of the protector plate 1*a* positioned at a receiving position of the conveyer 820. And when the base frame 630 contacts with the above-mentioned stopper which is positioned above the device 620, the limit switch (hereinafter referred to as a second limit switch) issues a signal to stop the motor 626 and to actuate the pneumatic cylinder 632 so as to transfer the yarn package from the waiting position to the gripping members 635. Consequently, the working positions of the first and second switches are selected so as to satisfy the above-mentioned transferring operations. Mounted to the device 600 are a relay (not shown) comprising a switch for connecting the electric source with the motor in plus polarity fashion (hereinafter referred to as a first switch), a switch for disconnecting the electric source with the motor (hereinafter referred to a neutral switch) and a switch for connecting the electric source with the motor in minus polarity fashion (hereinafter referred to as a second switch). Therefore, the above-mentioned relay is actuated by the first and second limit switches to change the switch connection by the neutral switch. A pair of delay timers are utilized in electric circuits for controlling the action of the above-mentioned relays so as to change the connection between the electric source and the motor 626 to actuate either one of the first and second switches in such a way that the motor 626 is driven after completion of the above-mentioned transferring motions. To attain the perfect transferring operation, the holding position of the yarn packages 4 in upright condition by the device 620*a* is set at a little higher position than the mounting position of the yarn packages on the first protector plate 1a while the plate 1a is positioned at a predetermined position on the conveyer 825 as illustrated in the previous paragraph.

Device for Supplying an Additional Sheet of Film and Sealing Yarn Packages with Films As shown in FIG. 7, a plurality of yarn packages 4 mounted on a first protector plate 1a covered with a sheet of film 6*a* is carried to the operating station of the device 700 for supplying an additional sheet of film 6*b*. Said device simultaneously supplies the additional film and seals the yarn packages, held by the holding caps 3, between the additional film and the film 6*a*.

Figure 51:
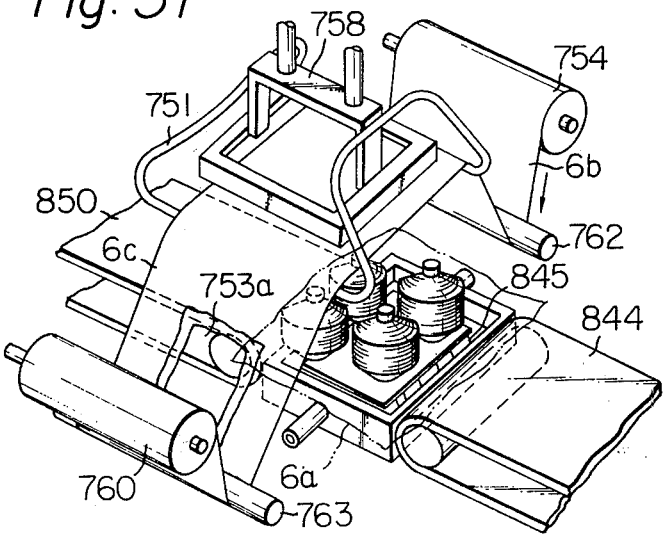
FIG. 51 is a perspective view of a second-film supplying and sealing device according to the present invention.
Figure 52:
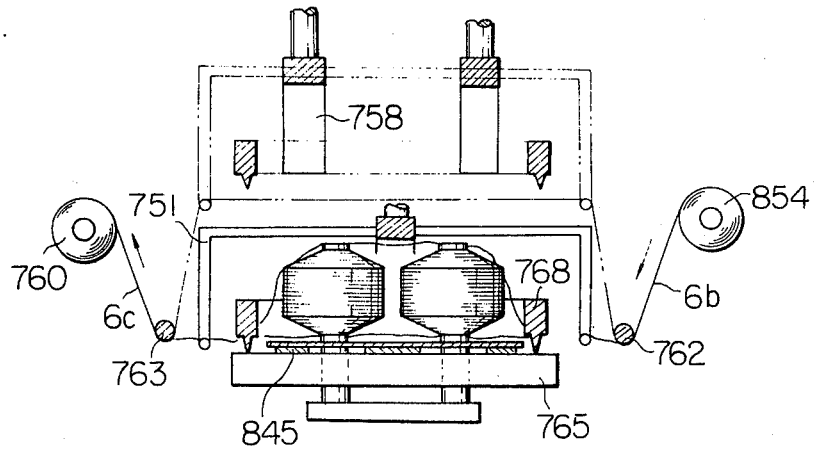
FIG. 52 is a schematic side view of the second-film supplying and sealing device shown in FIG. 51.
Figure 53:
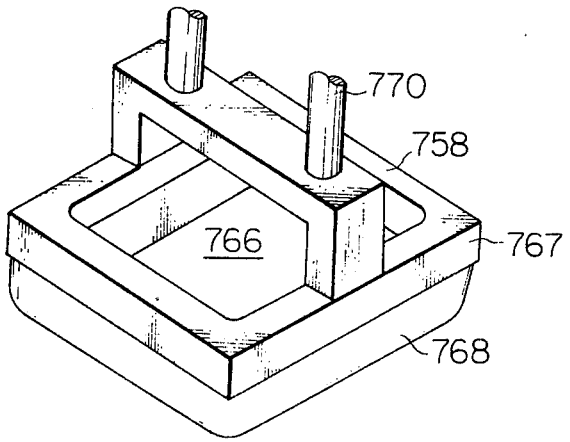
FIG. 53 is a perspective view of a heater of the device shown in FIG. 51.
Figure 54:
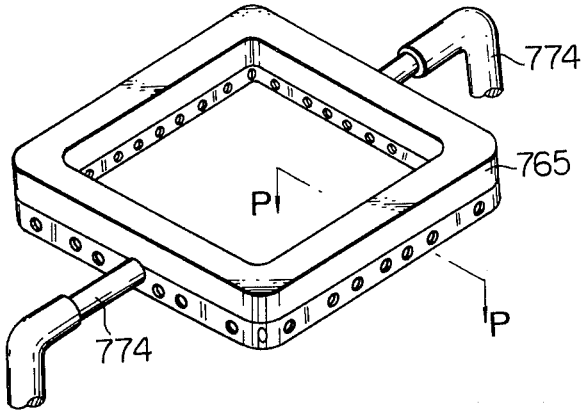
FIG. 54 is a perspective view of an anvil of the device shown in FIG. 51.
Figure 55:
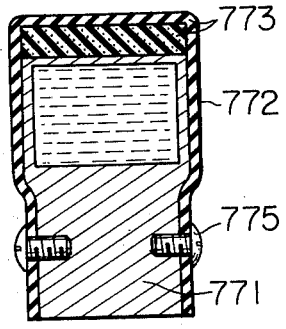
FIG. 55 is a cross sectional view of the anvil taken along a line P—P, in FIG. 54.

In order to correctly register the position of the first protector plate 1a at the above-mentioned operating station, a conveyer 845, such as the one already shown in FIGS. 44 and 51, is disposed at a position downstream of the conveyer 825 shown in FIG. 7. The above-mentioned conveyer has a stopper on its downstream side which has a construction and a function similar to those of the one illustrated in FIGS. 44 and 45. When the first protector plate 1*a* is stopped by this stopper, a limit switch, which is similar to the limit switch 842 in FIG. 45, connected to this stopper actuates the device for supplying the additional film and sealing the yarn packages with films (hereinafter simply referred to as "the sealing device"). Upon completion of the film supplying and sealing operation, the above-mentioned stopper recedes from the running passage of the first protector plate 1*a* holding the yarn packages 4 now sealed with the films, and the protector plate 1a is transported to the next operating station.

Now, a more detailed explanation will be presented with regard to the construction and function of the sealing device with reference to FIGS. 51 through 55.

In the case of the illustrated embodiment, a pair of film lifting bars 751 are disposed to a vertically movable seal heater 758. A film 6*b* delivered from a supply roll 754 is passed over the film lifting bar 751 and led to a take-up roll 760 located on the side of the seal heater 758 opposite to the supply roll 754 and the film 6*b* is maintained in a tensioned condition. Although the film lifting bars 751 are located on the both sides of the seal heater 758, i.e. one on the side of the supply roll 754 and the other on the side of the take-up roll 760, in the case of the illustrated embodiment, it is also applicable to omit the film lifting bar 751 located at side of the take-up roll 760. As the film lifting bar 751 is disposed to the vertically movable seal heater 758, the film 6*b* passes over the film lifting bar 751 on its path from the supply roll 754 to the take-up roll 760, and consequently the film 6*b* is moved vertically together with the seal heater 758.

Further, the part of the film lifting bar 751 adapted for contact with the film 6*b* is positioned slightly lower than the undersurface of the seal heater 758. In combination wit the above-mentioned construction, there are provided a pair of tension bars 762 and 763. When the film lifting bar bars 751 are positioned at a slightly lower level than the level of the tension bars 762, 763, the yarn packages 4 are covered covered by the additional film 6*b*.

As already mentioned, a stopper (not shown) is incorporated in the conveyer 845, which is similar to the stopper 841 installed on the mechanism for registering the position of the first protector plate 1a (see FIGS. 43 through 46), and this stopper stops the first protector plate 1*a* at the desired position. The yarn package 4 held by the catcher rings 3 of the first protector plate 1a via the film 6*a* are carried to the above-mentioned working position of the device 700 where the additional film 6*b* is positioned at its waiting position above the passage of the conveyer 845. Rotation of the take-up roll 760 is controlled by a suitable motor clutch (not illustrated) and the take-up roll 760 ceases its rotation after taking up in tensioned condition the prescribed length of film 6*b*. After the seal heater 758 is displaced downward in order to fuse the film 6*b* and the film 6*a* in such a condition that they wrap the yarn packages 4 the take-up roll 760 again rotates in order to tense the film 6*b* and remove the waste film concurrently. As already mentioned, the film 6*b* is kept in a tensioned condition through taking up the film 6*b*, wound on the supply roll 754, by the take-up roll 760, however, the take-up roll 760 is capable of rotating in the reverse direction or of maintaining a freely rotatable condition by operation of a suitable clutch (not shown) in order not to tense the film 6*b*.

In the mechanism of this film packing apparatus, the waste film 6*c* is lifted to a position higher than the yarn packages 4 together with the film 6*b* by the film lifting bar 751 upon elevation of the seal heater 758. Therefore, if the take-up roll 760 is rotated in this condition, the waste film 6*c* can be separated successfully from the second portion of film 6*b* and then the waste film 6*c* is wound on the takeup roll 760. It is also possible to concurrently tense the film 6*b*, for the sealing of the next yarn packages 4 held on the the next first protector plate 1*a*.

In FIGS. 51 through 55, there is shown the construction relating to the seal heater 758 and an anvil 765. As is clear from the illustration, the seal heater 758 comprises a framework 767 having a center space 766 for accommodation of the yarn packages 4, a heating member 768 fixed to the bottom of the framework 767 and having a center space too and guide rods 770 supporting the framework 767. The guide rods 770 are connected to a plunger of an air cylinder 769 shown in FIG. 7 for the vertical movement of the framework 767. The heating member 768 is always heated to a prescribed temperature by a suitable electric heater (not shown).

The anvil 765 comprises a framework 771 having a center space similar to the above-mentioned heating member 768 and an elastic tube 773 disposed on the frame work 771 in such a condition that the tube 773 is covered and carried by an elastic member 772. The elastic tube 773 is located over the framework 771 and is constantly cooled by cooling water circulating through conduits 774*a* (for supply) and 774*b* (for discharge). Further, the elastic member 772 is fixed to the framework 771 by set screws 775.

Device for Supplying and Superimposing the Second Protector Plate

Figure 56:
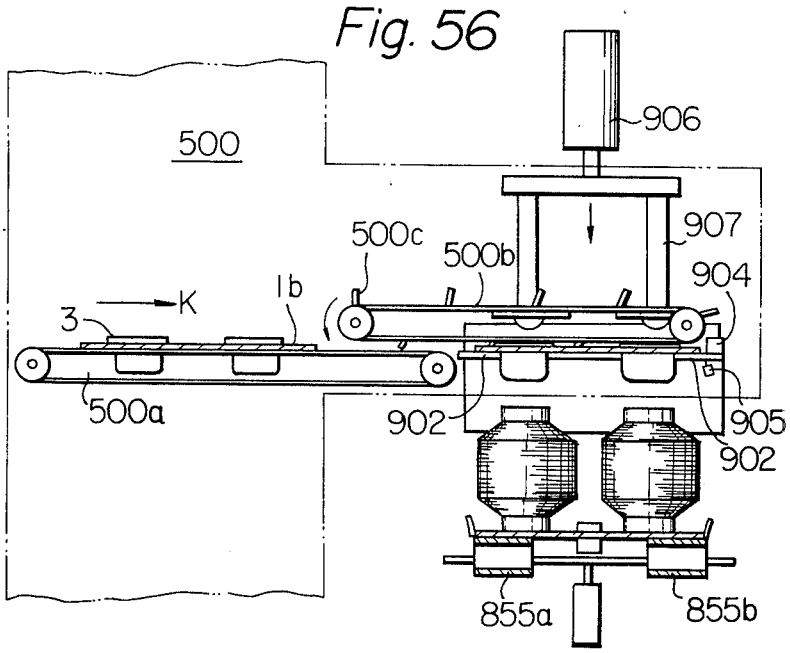
FIG. 56 is a schematic elevational view of a second protector plate supply device according to the present invention.
Figure 57:
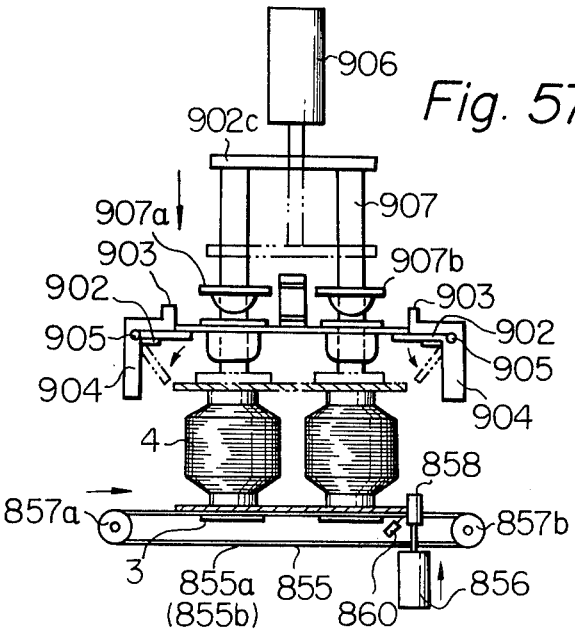
FIG. 57 is a side view of the second protector plate supply device shown in FIG. 56.

Referring to FIGS. 56 and 57, a plurality of yarn packages 4 sealed with film by the sealing device 750 are carried to the operating station of the successive device for supplying and superimposing the second protector plate 1*b* (hereinafter simply referred to as the superimposing device) by an assembly conveyor 855 while being held by the holding caps 3 of the first protector plate 1*a*. The structure of the conveyor 855 is similar to that of the conveyers 845. That is, a pair of endless belts 756*a* and 856*b* are provided in the operating station of the conveyer 855, the belts running over a pair of guide rollers 857*a* and 857*b*, one of these two rollers being a drive roller. The operating station further comprises a stopper 858 actuated by an air cylinder 859 for registering the position of the first protector plate 1*a* and a position registering mechanism which is similar to the position registering stopper 841 of the already mentioned position registering device (see FIGS. 44 and 45) for the first protector plate 1*a*.

When the first protector plate 1*a* is registered at a prescribed position by the operation of the stopper 858, the position registering mechanism couples with the holding caps 3 on the first protector plate 1*a* by the operation of a limit switch 860, operationally connected to the above-mentioned stopper 858, and the first protector plate 1*a* is stopped at the correct position. In order to prevent undersirable lateral sliding of same, a pair of guides 861*a* and 861*b* are provided at positions close to the upper surface of the belts 856*a*, 856*b* respectively. After complete supply and superimposing of the second protector plate 1*b*, the stopper 858 and the coupling member of the position registering mechanism recede from the passage of the first protector plate 1*a* and a plurality of yarn packages 4 sandwiched by the both protector plates 1*a*, 1*b* and sealed by the film 6 are now transported to the the operating station of the successive binding device.

The supply motion of the second protector plate 1*b* is hereinafter explained in detail.

A device 900 for superimposing the second protector plate 1*b* is provided at a position above the fixed position where the first protector plate 1*a* holding the sealed yarn packages 4 stops on the conveyer 855. This device is connected to a second protector plates reserving device 500, whose construction is similar to that of the already mentioned first protector plates reserving device 450, and a conveyer 500*a* disposed to the lower end of the reserving device 500 for transportation of the second protector plate 1*b* in the direction K of the arrow shown in FIG. 56. This conveyer 500*a* comprises two sets of flat or round belts in such an arrangement that holding caps 3 projecting downwards from the second protector plate 1*a* are located under the upper conveying surface of the conveyer 500*a*.

At a position slightly above the delivery end of the conveyer 500*a* is provided another conveyer 500*b* having tongue-like projections 500*c* which are made of a flexible material of a certain hardness such as rubber or plastic. Therefore, the second protector plate 1*b* is forced, at the delivery end of the conveyer 500*a*, to move into the space below the conveyer 500*b* according to the pushing action of the tongue-like projections 500*c*. A pair of receiver anvils 902 constructed from two flappers arranged in parallel in a common plane are disposed under the conveyer 500*b* at a position adjancently below the delivery end of the conveyer 500*a*. The second protector plate 1*b* urged by the projection is passed onto the receiver anvil 902. It is desirable to restrict the undesirable lateral sliding of the second protector plate 1*b* and for this purpose width limiting elements 903 are provided on the receiver anvils 902, respectively.

The receiver anvils 902 are usually kept in a horizontal disposition while pressed against supporting brackets 904 by suitable springs (not shown). However, upon application of a load greater than the spring force from the upper side, the receiver anvils 902 can turn to a tilted disposition about a pin 905 held by the supporting brackets.

A stopper 904 is disposed to the inner end of the receiver anvils 902 so that the second protector plate 1b stops its forward movement when passed onto the receiver anvils 902 even though conveyer 500*b* continues its motion. A detector 905 made up of a limit switch or a photo-cell element is located near the front face of the stopper 904 in order to produce a suitable signal or signals when the second protector plate 1*b* comes in to abutment with the stopper 904 and stops its movement.

A plurality of presser heads 907 are provided over the receiver anvil 902 in connection with the piston rod of a pneumatic cylinder 906 by way of a common bracket 907*c* for vertical movement, the pneumatic cylinder 906 being controlled by the signal or signals issued by the abovementioned detector 905. These presser heads are arranged so as to coincide with the arrangement of the catcher rings 3 of the second protector plate 1*b*. When the pressor head 907 moves downwards by the operation of the pneumatic cylinder 906, the holding caps 3 of the second protector plate 1*b* are pushed down. The receiver anvil 902 is consequently subjected to the downward force via the second protector plate 1*b* placed thereon and, as already mentioned, turns downwards to the tilted disposition as represented by a dott-dash line in FIG. 57. By this turning of the receiver anvil 902, the holding caps 3 of the second protector plate 1b lower to a position under the receiver anvils 902 and are inserted over the respective bobbins 4*a* of the yarn packages 4 held by the first protector plate 1*a* positioned at the prescribed location on the conveyer 855.

Each presser head 907 is provided at its front end with a semi-spherical element 907*a* adapted for coupling with the hollow part of each holding cap 3 of the second protector plate 1*b*, by way of a flange 907*b* which is pressed down toward the holding cap 3. The arrangement is so designed that, when the sealed with the film 6 is stopped at the prescribed position on the conveyer 855 the yarn package bobbins 4*a* are positioned in correctly aligned condition even though the yarn bobbins 4*a* were previously aligned in slightly disordered condition. Consequently the presser head 907 provided with the semi-spherical elements 907*a* or provided with a round shoulders formed at the bottom surface thereof is capable of engaging the elements 907*a*, 907*b* into the respective holding caps 3 of the second protector plates 1*b*.

Device for Turning an Intermediate Unit Package.

Figure 58:
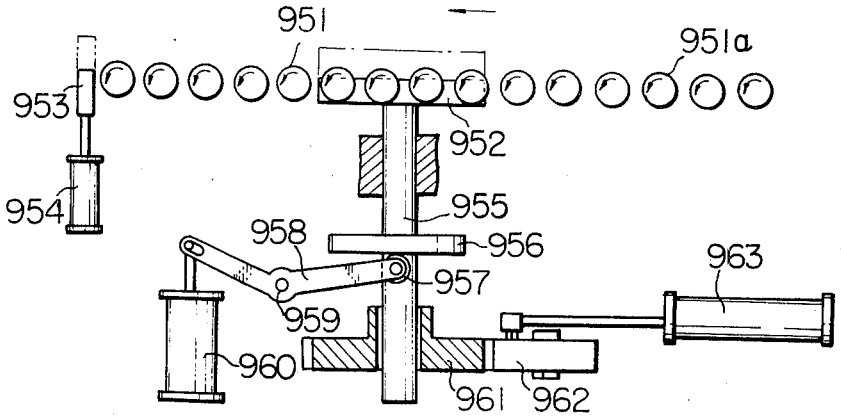
FIG. 58 is a schematic side view of a device for turning a combined body according to the present invention.
Figure 59:
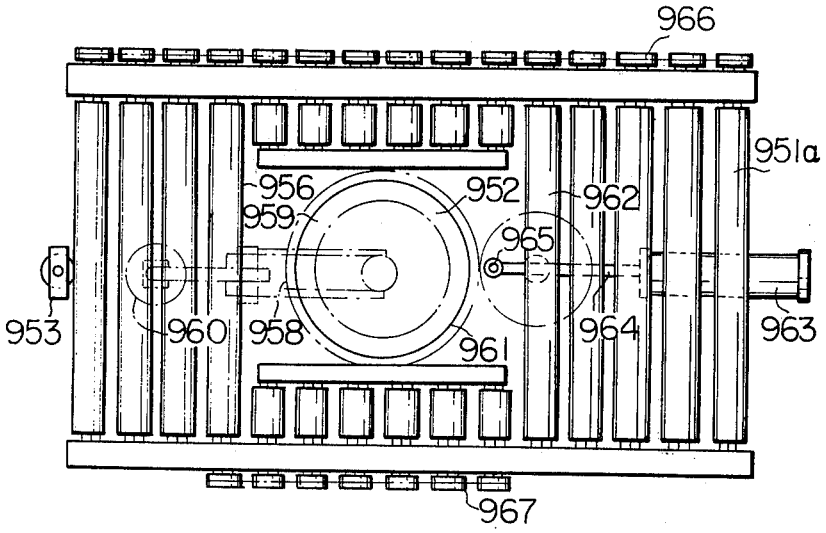
FIG. 59 is a schematic plan view of the turning device shown in FIG. 58.

Referring to FIG. 47, when the second protector plate 1*b* is superimposed on the yarn packages 4 sealed with the film 6 and held by the first protector plate 1*a*, the formation of an intermediate unit package is completed. However, before transporting the intermediate unit package to the conventional binding apparatus 1000, it is preferable to turn the intermediate unit package in such a manner that the folded portions 2*a*, 2*b* of the first and second protector plates 1*a*, 1*b* are positioned so that they are free from the binding operation of the binding apparatus. In the embodiment shown in FIG. 7, the intermediate unit package is turned by 90° horizontally by a turning device 950. Referring to FIGS. 58 and 59, this device for turning the intermediate unit package (hereinafter simply referred to as the turning device) comprises in combination with a roller conveyer 951 provided with a plurality of rollers 951*a*, a turn table 952 located a little below the plane defined by the top surface of the rollers 951*a*, and a mechanism for lifting this turn table 952 in its axial direction, when necessary, and a mechanism for turning the table 952 by 90° about its axis during the lifting movement, a stopper 953 operated by a pneumatic cylinder 954 so as to stop the intermediate unit package on this turn table 952 and a mechanism for driving the above-mentioned rollers 951*a* at an identical surface speed.

The lifting mechanism for the turn table 952 comprises a horizontal disc 956 fixed to a shaft 955 thereof, a lever 958 for rotatably supporting a roller 957 which contacts the lower surface of the horizontal disc 956, a horizontal shaft 959 for turnably supporting the lever 958 and a pneumatic cylinder 960 connected via the plunger to the other end of the lever 958.

The turning mechanism comprises a gear 961 mounted on the shaft 955 by a spline engagement, another gear 962 meshing with this gear 961 and a crank mechanism for driving the latter gear 962, the crank mechanism being constructed from a pneumatic cylinder 963, its plunger 964 and a pin 965 for connecting the plunger 964 to the gear 962. The rollers 951*a* are are all driven by drive belts 966 and 967.

Upon abutment of the supplied intermediate unit package with the stopper 953 which is operationally connected to the second protector plate supply device 900, the intermediate unit package stops at a position corresponding to that of the turntable 952, the pneumatic cylinder 960 is actuated by a limit switch (not shown) connected to the stopper 953 and the roller 957 is moved upwards as a result the disc 956 is pushed up until the upper surface of the turn table 952 comes to a level higher than that of the transporting plane given by the roller conveyer 951. Concurrently with this, the pneumatic cylinder 963 starts its operation for rotating the gear 962 by one complete revolution. As the gear ratio between the gears 962 and 961 is 1 : ¼, one complete revolution of the gear 962 causes one-fourth revolution, i.e. 90° rotation, of the gear 961, consequently the turn table 952 turns by 90° about its axis and the directional phase of the intermediate unit package is changed by 90° too. Next, a suitably installed timeswitch (not shown) operates so that the pneumatic cylinders 954, 960 and 963 return to their initial dispositions, and the turntable returns to its lower stand-by station so that the intermediate unit package is passed to the following binding device 970 by the operation of of the roller conveyer 951.

What we claim is:

1. An automatic apparatus for making a unit package comprising a pair of protector plates having identical construction and a plurality of yarn packages rigidly held by said protector plates in parallel relationship each other and in non contact condition each other and a closed film enclosing said yarn packages inside said protector plates in sealed condition and at least a pair of closed tapes or strands tightly binding said protector plates, comprising in combination, an assembling conveyer means, a first means for reserving a plurality of said protector plates as first protector plates and supplying single protector plate positioned at a position adjacently upstream of said assembling conveyer means, means for supplying a first sheet of film on said first protector plate in superposed condition when said first protector plate is supplied from said first means for reserving and supplying said protector plates to a predetermined position on said assembling conveyer means, means for temporarily positioning a first combined body of said first protector plate with said first sheet of film on a position for mounting a plurality of said yarn packages on predetermined positions of said first protector plate via said first sheet of film, means for simultaneously supplying a second sheet of film on a second combined body composed of said yarn packages and said first protector plate and said first sheet of film and for sealing said first and second sheet of films, a second means for reserving a plurality of said protector plates as second protector plates and supplying single second protector plate on said plurality of yarn packages mounted on said first protector plate in sealed condition with said first and second sheet of films, means for binding said first and second protector plates of said fourth combined body with a pair of said closed tapes, so that said unit package is produced, means for intermittently driving all of said means in synchronous condition each other.

2. An automatic apparatus for making a unit package according to claim 1, further comprising in combination means for packaging at least one said unit package in a carton.

3. An automatic apparatus for making a unit package according to claim 1, further comprising in combination; means for turning 90° said fourth combined body composed of said first and second protector plates and a plurality of yarn packages sandwiched by said first and second protector plates in sealed condition with said first and second sheet of films, said turning means disposed at a position between said second means for supplying said second protector plate and said binding means.

4. An automatic apparatus for making a unit package according to claim 1, further comprising means for automatically assembling a plurality of yarn packages reserved at a waiting position adjacent to said assembling conveyer means on predetermined positions of said first protector plate of said first combined body while said first combined body is temporarily positioned at an assembling position on said assembling conveyer means by said temporarily positioning means.

5. An automatic apparatus for making a unit package according to claim 1, further comprising means for automatically making said protector plates and means for supplying said protector plates to said first and second means for reserving them respectively.

6. An automatic apparatus for making a unit package according to claim 5, wherein said supply means of protector plates comprises a first supply means connected to said first reserve means of said first protector plates and a second supply means connected to said second reserve means of said second protector plates, means for alternately connecting said protector plate-making means with said first or second supply means, said second supply means is provided with means for turning over said protector plates supplied from said protector plate-making means.

7. An automatic apparatus for making a unit package according to claim 1, wherein said assembling conveyer means comprises a plurality of sub-conveyers arranged in alignment, each of said sub-conveyers disposed at positions upstream said turning means comprises a pair of guide rollers and at least a pair of endless belts mounted separately each other on said guide rollers at both ends portion thereof, one of said guide rollers is a drive roll for driving said endless belts, all sub-conveyers are synchronously intermittently driven by said driving means, each sub-conveyer is provided with means for stopping said first protector plate at a predetermined position thereon temporarily.

8. An automatic apparatus for making a unit package according to claim 1, wherein said first film supplying means comprises, a pair of guide rails transversely disposed above said assembling conveyer, a frame supporting said guide rails, a roll-film supporting device mounted on said frame at a position outside of said assembling conveyer, a pair of guide rolls rotatably mounted on said frame at a position above said roll-film supporting device, a carrying device being capable of traversing on said guide rails, clamp means mounted on said carrying device, cutting means disposed at a position adjacently outside a terminal of traversing passage of said carrying device along said guide rails, means for detecting an arrival of said first protector plate to a predetermined position on said assembling conveyer means for temporarily stopping said first protector plate at a position on said assembling conveyer being adjacently below said traversing passage of said carrying device means for driving said carrying device when said stopping means is actuated, means for actuating said driving means in one direction or a reverse direction when said carrying device is displaced to terminals of said traverse motion thereof, said actuating means also actuates said clamp device and said cutting means, said stopping means is actuated by a signal from said detecting means, whereby when said detecting means detects an arrival of said first protector plate to said predetermined position on said assembling conveyer, said clamp means grips a free edge of said rolled film delivered from said supporting device via said pair of rolls, and said free edge of film is displaced to an outside terminal of said traverse motion of said carrying device, when said carrying device arrives at said outside terminal on said guide rolls, said actuating means stops the running of said driving means and actuates said cutting means so that said film is cut and also actuates said clamp means so as to release from said edge of film, thereafter actuates said driving means so as to drive reversely, when said carrying means is arrived at another terminal of traverse motion of said carrying means, said actuating means stops the running of said driving means.

9. An automatic apparatus for making a unit package according to claim 7, wherein said temporarily positioning means comprises, in combination with said first protector plate provided with a plurality of holding caps for holding said yarn packages, a first pneumatic cylinder disposed at a position below an upper surface of said sub-conveyer, said first pneumatic cylinder provided with a stopper connected to a plunger of said pneumatic cylinder, in such a condition that said stopper is capable of stopping displacement of said first protector plate toward downstream of said assembling conveyer when said first pneumatic cylinder is actuated, a second pneumatic cylinder disposed below said sub-conveyor at a position upstream of said assembling conveyer to said first pneumatic cylinder, a horizontal bracket secured to a plunger of said second pneumatic cylinder, a plurality of upright pegs rigidly mounted on said horizontal bracket at particular positions corresponding to an arrangement of said holding caps of first protector plate, distance between said first and second pneumatic cylinders is fixed in such a condition that when said first and second pneumatic cylinders are actuated so that said first protector plate is stopped by said stopper, said pegs are capable of engaging with respective catcher rings from underside of said protector plate, and said two endless belts are mounted on said guide rollers in such a condition that said pegs are capable of passing upward through a space between said endless belts when said second pneumatic cylinder is actuated.

10. An automatic apparatus for making a unit package according to claim 1, wherein said means for simultaneously supplying a second sheet of film on a second combined body composed of said yarn packages and said first protector plate and said first sheet of film and for sealing said first and second sheet of films comprises a device for supplying said second sheet of film on said second combined body and a device for sealing said first and second sheet of films, and a device for actuating said film supply device and said sealing device in relative condition, said film supply device being disposed above said assembling conveyer in transversal relation to said assembling conveyer and said sealing device being disposed above a position crossing said supply device and said assembling conveyer in vertically displaceable condition, said sealing device comprising a horizontal heating member provided with a square shaped central aperture having sufficient space for permitting the passing of said yarn packages mounted on said first protector plate and a framework rigidly superimposed on said heating member and a bracket for supporting said framework and a pneumatic cylinder for displacing said bracket from a waiting position to said first protector plate and at least one lifting bar mounted to said bracket at an outside of said heating member in such a way that said lifting bar is capable of positioning at substantially same level as said first protector plate when said heating member is urged to said first protector plate by a motion of said pneumatic cylinder, said lifting bar crosses a film supply passage by said film supply device, said film supply device comprises a film supply roll and a take-up roll disposed at an outside position of said assembling conveyer in opposite condition to said film supply device, at least one tension bar disposed at intervened positions between said film supply roll and said assembling conveyer, and/or between said take-up roll and said assembling conveyer, said tension bar defines a passage of said second film.

11. An automatic apparatus for making a unit package according to claim 1, wherein said second means for reserving a plurality of said second protector plates and superimposing said second protector plates on said plurality of yarn packages mounted on said first protector plate one by one comprises a second protector plates reserving device disposed at a position adjacent to said assembling conveyer and a device for supplying said second protector plates from said second reserving device on said plurality of yarn packages, said superimposing device comprises a first horizontal conveyer for taking said second protector plates from said second reserving device one by one, a second horizontal conveyer disposed above said assembling conveyer in transversal condition, a pair of receiver anvils turnably disposed adjacently below said second conveyer, a stopper disposed to an inner end of said receiver anvil, means for positively pushing said second protector plate to said yarn packages when said second protector plate is carried to said receiver anvils and stopped by said stopper, said second conveyer is arranged in partly overlapped condition with said first conveyer and provided with a plurality of torque like projections, said pushing means comprises a plurality of pressing heads arranged at particular positions facing bobbins of said yarn packages and a bracket supporting said pressing heads and a pneumatic cylinder connected to said bracket for positively pressing said pressing heads to said bobbins of said yarn packages.

12. An automatic apparatus for making a unit package according to claim 1, wherein said means for turning 90° said fourth combined body comprises a combination with a roller conveyer comprising a plurality of rollers, a turnable located a little below a plane defined by top surfaces of said rollers, a mechanism for lifting said turn table in an axial direction thereof, a mechanism for turning said turn table by 90° about axis thereof during lifting movement of said turn table, a pneumatic cylinder disposed at a position adjacently downstream to said turn table, a stopper connected to said pneumatic cylinder in a capable condition to project upward beyond said plane defined by top surfaces of said rollers, said lifting mechanism and turning mechanism are relatively actuated by a motion of said stopper.

13. An automatic apparatus for making a unit package according to claim 4, wherein said automatic assembling means comprises a frame disposed at a superimposed position above said waiting position, means for taking said yarn packages from said waiting position and means for displacing said taking means from said waiting position to a position adjacently above a position for mounting said yarn packages on a first protector plate positioned at said assembling position, means for actuating said taking means.

14. An automatic apparatus for making a unit package according to claim 5, wherein said means for making said protector plates comprises in combination, a first conveyer belt, a device for supplying cardboard sheets to said first conveyer belt one by one, a device for mounting holding caps on each cardboard sheet carried by said first conveyer belt, and a device for folding a pair of edges of a cardboard sheet provided with said holding caps, and a second conveyer belt for displacing said protector plates to a working position of said folding device.

* * * * *

UNITED STATES PATENT OFFICE

CERTIFICATE OF CORRECTION

Patent No. 3,948,022 Dated April 6, 1976

Inventor(s) Eiji Minaka, et al

It is certified that error appears in the above-identified patent and that said Letters Patent are hereby corrected as shown below:

In the Abstract:

Col. 2, lines 23-26 - delete "plates....line."

Col. 2, line 40 - change "thee" to --the--
Col. 9, line 41 - change "255" to --855--
Col. 9, line 54 - between "respective" and "devices" insert --reserve--
Col. 15, line 45 - correct spelling of "catcher"
Col. 20, line 43 - correct spelling of "belts"
Col. 21, line 16 - after "wheel" change "213" to --231--
Col. 22, line 67 - change "in" to --is--
Col. 23, line 43 - change: "$L/2 < h1$ L" to --$L/2 < h1 \leq L$--
Col. 23, line 51 - change "first" to --firstly--
Col. 24, line 4 - change "chute 312" to --chute 342--
Col. 30, line 21 - correct spelling of "pneumatic"
Col. 32, line 64 - between "second" and "switches" insert --limit--
Col. 34, line 7 - correct spelling of "with"
Col. 41, line 32 - change "a" to --in--

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*